US009422747B2

(12) United States Patent
Rodan et al.

(10) Patent No.: US 9,422,747 B2
(45) Date of Patent: Aug. 23, 2016

(54) MOTORIZED CLOSURE ASSEMBLY

(71) Applicant: SLIDER NEXT VISION LTD., Netanya (IL)

(72) Inventors: Yoav Rodan, D.N Bikat Beit Hakerem (IL); Giora Silne, Karmiel (IL)

(73) Assignee: SLIDER NEXT VISION LTD., Netanya (IL)

( * ) Notice: Subject to any disclaimer, the term of this patent is extended or adjusted under 35 U.S.C. 154(b) by 0 days.

(21) Appl. No.: 14/550,533

(22) Filed: Nov. 21, 2014

(65) Prior Publication Data

US 2015/0075076 A1 Mar. 19, 2015

Related U.S. Application Data

(63) Continuation-in-part of application No. 13/956,026, filed on Jul. 31, 2013, now Pat. No. 8,919,042, which is a continuation-in-part of application No. 13/589,873, filed on Aug. 20, 2012, now Pat. No. 8,800,206.

(51) Int. Cl.

| | |
|---|---|
| ***E05F 11/00*** | (2006.01) |
| ***E05B 47/02*** | (2006.01) |
| ***E05F 15/643*** | (2015.01) |
| ***E05B 17/22*** | (2006.01) |
| ***E05B 47/00*** | (2006.01) |
| ***E05B 65/08*** | (2006.01) |
| ***E05C 1/08*** | (2006.01) |
| ***E05C 19/00*** | (2006.01) |
| ***E05F 15/635*** | (2015.01) |
| ***E05F 15/73*** | (2015.01) |
| ***E05F 15/77*** | (2015.01) |

(Continued)

(52) U.S. Cl.

CPC ..... *E05B 47/026* (2013.01); *E05B 17/22* (2013.01); *E05B 47/0012* (2013.01); *E05B 47/02* (2013.01); *E05B 63/0004* (2013.01); *E05B 65/08* (2013.01); *E05B 65/0864* (2013.01); *E05C 1/08* (2013.01); *E05C 19/00* (2013.01); *E05C 21/00* (2013.01); *E05F 15/635* (2015.01); *E05F 15/643* (2015.01); *E05F 15/73* (2015.01); *E05F 15/77* (2015.01); *E05B 2047/0072* (2013.01); *E05B 2047/0094* (2013.01); *E05Y 2201/672* (2013.01); *E05Y 2900/132* (2013.01); *G07C 2009/00769* (2013.01); *Y10T 70/625* (2015.04); *Y10T 292/1021* (2015.04)

(58) Field of Classification Search

USPC ..... 49/358, 360, 404

See application file for complete search history.

(56) References Cited

U.S. PATENT DOCUMENTS 2,334,981 A * 11/1943 Ackley ..... 74/89.22
2,346,388 A * 4/1944 Peebles ..... 49/360

(Continued)

FOREIGN PATENT DOCUMENTS

JP 02243893 A * 9/1990 ..... E05F 15/14

*Primary Examiner* — Jerry Redman

(74) *Attorney, Agent, or Firm* — Soroker Agmon Nordman

(57) ABSTRACT

The disclosure is directed to motorized closure assembly, comprising: an opening frame configured to fit around the opening; a substantially rectangular closure slab having a closure slab frame configured to surround the substantially rectangular closure slab and sealingly fit within the opening frame; and a motorized driver, wherein the motorized driver is entirely embedded within the closure slab frame or within a combination of the closure slab frame and the opening frame, the motorized driver configured to slidably move the slab between an open position and a closed position.

12 Claims, 17 Drawing Sheets

(51) Int. Cl.

| | |
|---|---|
| ***E05B 63/00*** | (2006.01) |
| ***E05C 21/00*** | (2006.01) |
| *G07C 9/00* | (2006.01) |

(56) References Cited

U.S. PATENT DOCUMENTS

| | | | | | |
|---|---|---|---|---|---|
| 3,331,428 | A | * | 7/1967 | Ford | 160/331 |
| 3,890,744 | A | * | 6/1975 | Galis | 49/360 |
| 3,913,267 | A | * | 10/1975 | Knippel et al. | 49/220 |
| 3,913,268 | A | * | 10/1975 | Paterson | 49/220 |
| 4,149,615 | A | * | 4/1979 | Kappenhagen | 187/324 |
| 4,674,231 | A | * | 6/1987 | Radek et al. | 49/118 |
| 4,893,435 | A | * | 1/1990 | Shalit | 49/360 |
| 5,251,402 | A | * | 10/1993 | Richardson et al. | 49/404 |
| 5,440,837 | A | * | 8/1995 | Piltingsrud | 49/139 |
| 5,640,806 | A | * | 6/1997 | Hall | 49/360 |
| 6,125,585 | A | * | 10/2000 | Koneval et al. | 49/349 |
| 6,324,788 | B1 | * | 12/2001 | Koneval et al. | 49/121 |
| 6,581,332 | B1 | * | 6/2003 | Kim | 49/358 |
| 6,990,771 | B2 | | 1/2006 | Pfaff | |
| 7,124,469 | B2 | * | 10/2006 | Tsekhanovsky et al. | 16/79 |
| 7,337,581 | B2 | * | 3/2008 | Kriese | 49/360 |
| 7,506,727 | B2 | * | 3/2009 | Spiess | 187/340 |
| 7,533,926 | B2 | * | 5/2009 | Mitsui et al. | 296/155 |
| 8,474,185 | B2 | * | 7/2013 | Busch | 49/358 |
| 8,800,206 | B2 | * | 8/2014 | Vaknin et al. | 49/358 |
| 8,919,042 | B2 | * | 12/2014 | Vaknin | 49/358 |
| 2009/0300989 | A1 | * | 12/2009 | Oberheide et al. | 49/360 |
| 2012/0066976 | A1 | * | 3/2012 | Murray et al. | 49/358 |
| 2012/0272576 | A1 | * | 11/2012 | Van Tassell et al. | 49/70 |
| 2012/0285093 | A1 | * | 11/2012 | Tarrega Lloret | 49/358 |
| 2013/0212948 | A1 | * | 8/2013 | Nixon | 49/349 |

* cited by examiner

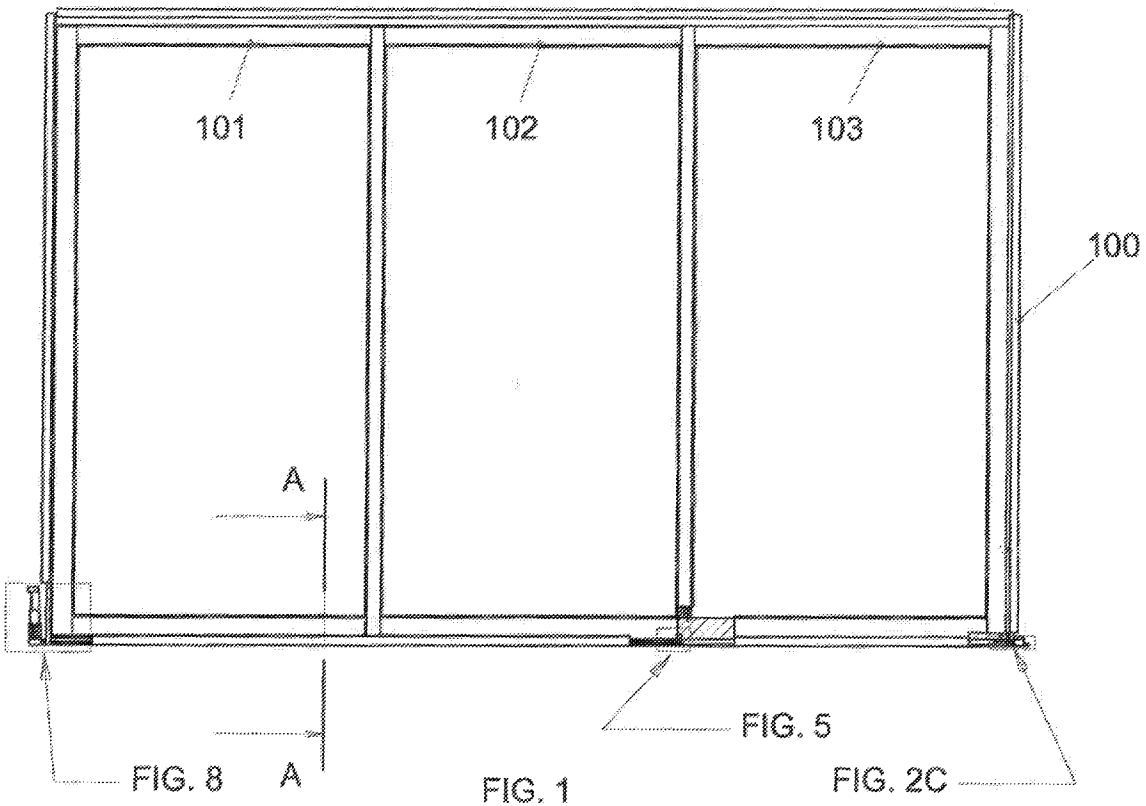
100
103
102
101
A
A
FIG. 2C
FIG. 5
FIG. 1
FIG. 8
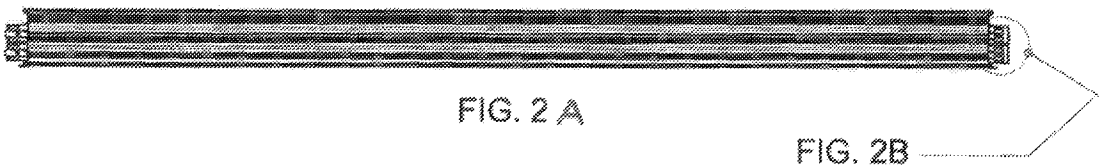
FIG. 2B
FIG. 2 A Section A-A

MOTORIZED CLOSURE ASSEMBLY

CROSS REFERENCE TO RELATED APPLICATIONS

This application is a continuation-in-part of U.S. application Ser. No. 13/956,026 filed on Jul. 31, 2013 now U.S. Pat. No. 8,919,042, which is a continuation in part of U.S. application Ser. No. 13/589,873 filed on Aug. 20, 2012, now U.S. Pat. No. 8,800,206, both of which are incorporated herein by reference in their entirety.

BACKGROUND

The disclosure is directed to motorized closure assembly. Specifically, the disclosure is directed to motorized sliding windows and doors.

Building doors and windows include a number of different types of designs such as overhead doors and windows, horizontal sliding doors and windows, vertical lift doors and windows, folding doors and windows, pocket doors and windows, roller doors and windows etc. With space for buildings and apartments getting increasingly small, so does the space available for any driving mechanisms configured to open and close these doors and windows.

Additionally, safety and aesthetic considerations impose design restrictions making commonly used externally visible and accessible drive mechanisms undesirable.

Accordingly, there is a need for concealed drive mechanisms for doors.

SUMMARY

In an embodiment, provided is a motorized closure assembly, comprising: an opening frame configured to fit around the opening; a substantially rectangular closure slab having a closure slab frame configured to surround the substantially rectangular closure slab and sealingly fit within the opening frame; a driver, the driver concealed in a recess behind the opening frame and coupled to a driver pulley; a frame pulley, concealed in a recess behind the opening frame on a side opposite the driver; and a cable having a proximal end and a distal end, disposed between the first frame pulley the driver pulley, and operably coupled to the slab frame wherein the driver, the cable, the motor pulley and the first frame pulley are concealed regardless of the position of the closure slab in relation to the opening frame, the assembly capable of slidably moving the slab between an open position and a closed position.

In an embodiment, provided herein is a motorized closure assembly, comprising: an opening frame configured to fit around at least the top horizontal side, a distal vertical side, and a bottom horizontal side of a substantially rectangular opening; a substantially rectangular closure slab having a closure slab frame configured to surround the substantially rectangular closure slab and sealingly fit within the opening frame; a driver, the driver embedded within a proximal vertical side of the substantially rectangular closure slab and coupled to a driver pulley; a frame pulley, embedded within and coupled to a distal horizontal side of the substantially rectangular closure slab on a horizontal side opposite the driver pulley; a first free pulley disposed between the driver pulley and the first frame pulley and operably coupled to the closure slab frame; and a cable connecting the motor pulley, the first free pulley and the frame pulley, wherein the cable and the free pulley are embedded within the closure slab frame.

In yet another embodiment, provided herein is a motorized closure assembly, comprising: an opening frame configured to fit around the opening; a substantially rectangular closure slab having a closure slab frame configured to surround the substantially rectangular closure slab and sealingly fit within the opening frame; and a motorized driver, wherein the motorized driver is entirely embedded within the closure slab frame or within a combination of the closure slab frame and the opening frame, the motorized driver configured to slidably move the slab between an open position and a closed position.

In an embodiment, provided herein is a motorized closure mechanism comprising: a driver; a cable or a belt configured to extend across a closure frame, coupled to a movable closure pane at a predetermined tension using a tension modulator, wherein the mechanism is integral and concealed within the closure frame, and wherein the tension is affected using biased coupling to the movable closure pane or to the driver.

BRIEF DESCRIPTION OF THE DRAWINGS

The features of the motorized opening closure described will become apparent from the following detailed description when read in conjunction with the drawings, which are exemplary, not limiting, and wherein like elements are numbered alike in several figures and in which:

FIG. 1, shows an illustration of an opening comprising three motorized panes according to an embodiment of the technology;

FIGS. 2A-2C, FIG. 2A shows an illustration of an opening frame according to an embodiment of the technology where FIG. 2B shows the first frame pulley assembly as in inset of FIG. 2A and FIG. 2C shows the coupling of the first frame pulley and the closure slab frame;

FIG. 3B shows the driver in relation to the opening frame as an inset, and FIG. 3C shows a perspective illustration of the driver of FIG. 3B;

DETAILED DESCRIPTION

Figure 2B:
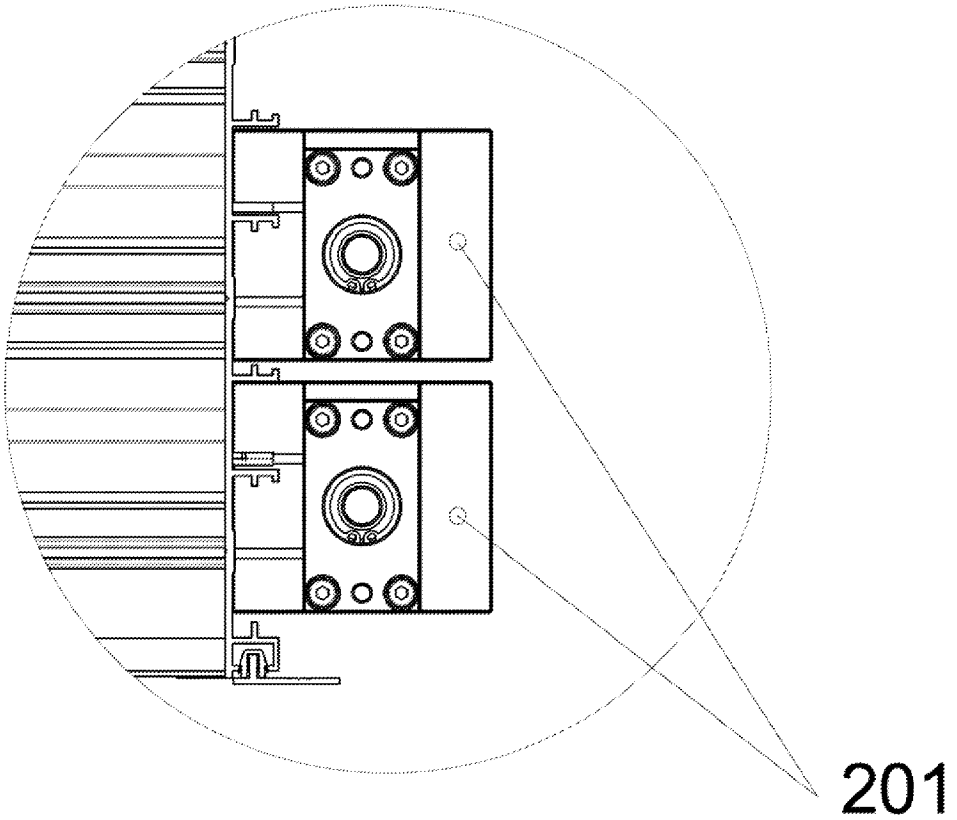

The disclosure relates in one embodiment to motorized closure assembly. In another embodiment, the disclosure relates to motorized sliding windows and doors. Accordingly, provided herein are motorized closure assemblies, comprising: an opening frame configured to fit around the opening; a substantially rectangular closure slab having a closure slab frame configured to surround the substantially rectangular closure slab and sealingly fit within the opening frame; and a motorized driver, wherein the motorized closure assembly is entirely embedded within the closure slab frame or within a combination of the closure slab frame and the opening frame Detailed embodiments of the present technology are disclosed herein; however, it is to be understood that the disclosed embodiments are merely exemplary, which can be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "first," "second," and the like, herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the pulley(s) includes one or more pulley). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

In addition, for the purposes of the present disclosure, directional or positional terms such as "top", "bottom", "upper," "lower," "side," "front," "frontal," "forward," "rear," "rearward," "back," "trailing," "above," "below," "left," "right," "horizontal," "vertical," "upward," "downward," "outer," "inner," "exterior," "interior," "intermediate," etc., are merely used for convenience in describing the various embodiments of the present disclosure.

In an embodiment, provided herein is a motorized closure assembly, comprising: an opening frame configured to fit around the opening; a substantially rectangular closure slab having a closure slab frame configured to surround the substantially rectangular closure slab and sealingly fit within the opening frame; a driver, the driver concealed in a recess behind the opening frame and coupled to a driver pulley; a frame pulley, concealed in a recess behind the opening frame on a side opposite the driver; and a cable having a proximal end and a distal end, disposed between the first frame pulley the driver pulley, and operably coupled to the slab frame wherein the driver, the cable, the motor pulley and the first frame pulley are concealed regardless of the position of the closure slab in relation to the opening frame, the assembly capable of slidably moving the slab between an open position and a closed position.

Figure 12:
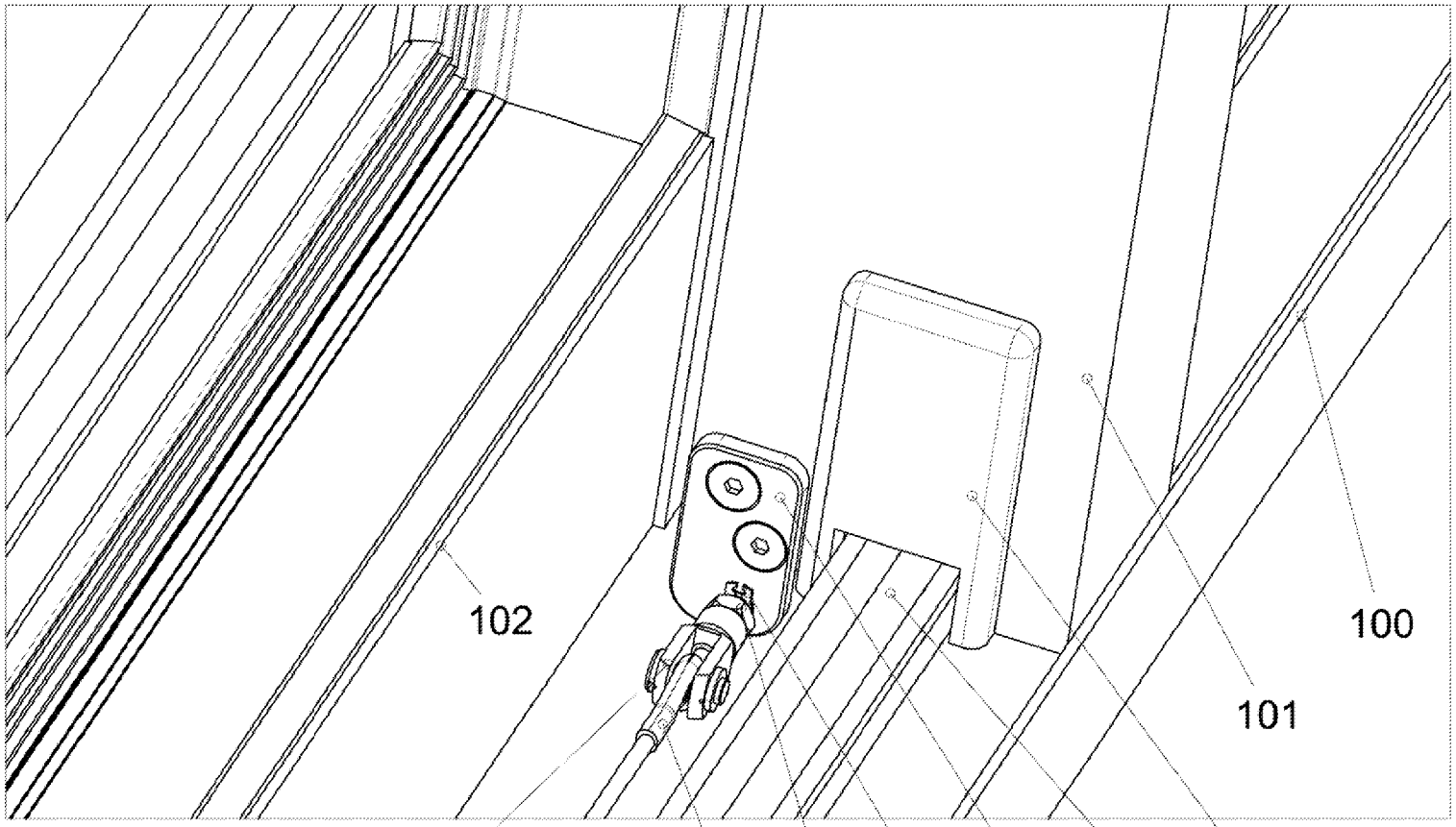
FIG. 12 shows an illustration of an internal pane cable coupling and assembly covering according to an embodiment of the technology.
Figure 14:
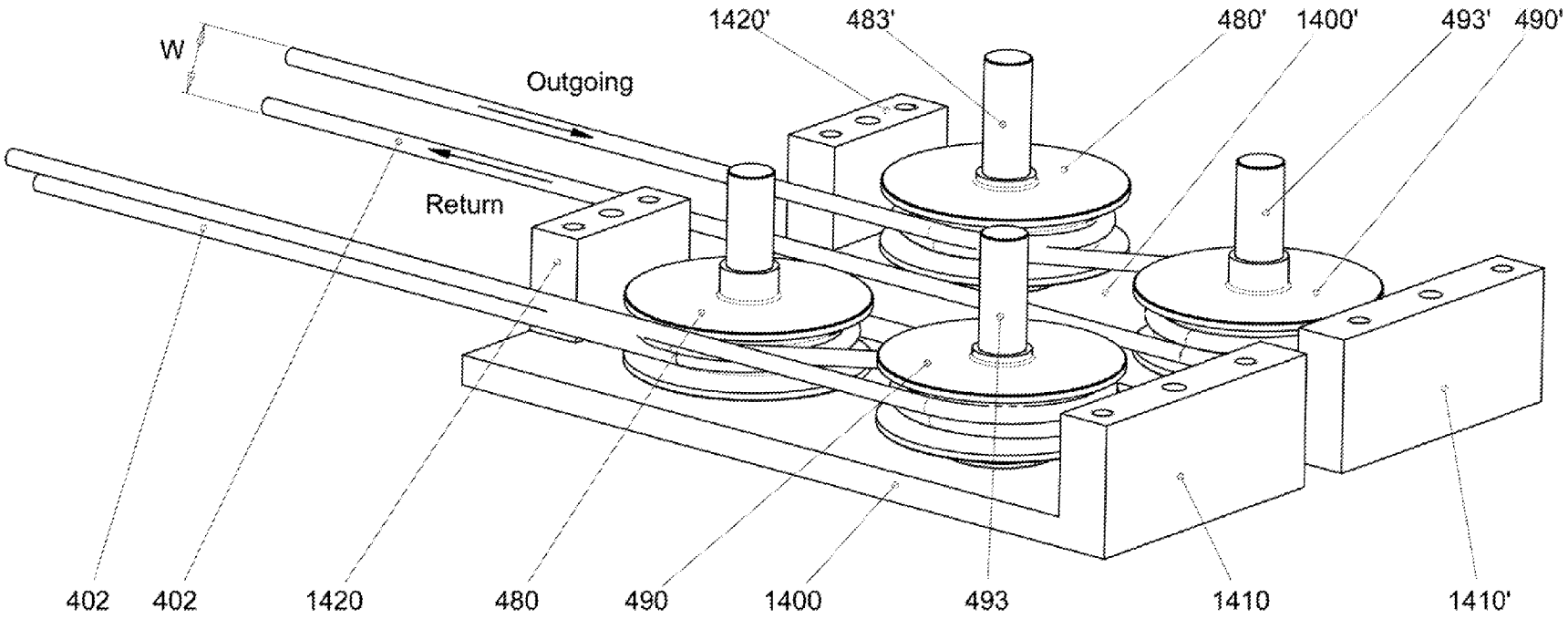
FIG. 14 shows an illustration of adjacent first and second frame pulley system with tandem pulleys in close proximity and looping wire to increase friction.

As used herein, "concealed" means that the cable, the motor pulley and the slab first frame pulley are sufficiently enclosed or embedded within the opening frame and/or the slab frame such that, in the normal and typical use of the motorized closure, the user does not typically come into contact with and/or get entangled in, and/or may observe the cable. Thus, the term "concealed" does not necessarily mean that the cable is completely hidden from view when the motorized closure slab is in use in the closed position. Rather, the cable may be slightly/partially visible, as can be seen in FIGS. 12, and 14 but it is sufficiently recessed within and covered by the closure slab frame in normal use. The term "embedded" refers to the cable, the driver, the driver pulley, first frame pulley or other pulleys described herein (e.g., secondary driver pulley and secondary frame pulley), being coupled firmly within a surrounding structure, or enclosed snugly or firmly within a material or structure, for example, the closure slab frame, the pane frame or the opening frame and their combination.

The term "coupled", including its various forms such as "operably coupling", "coupling" or "couplable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection.

The opening can be substantially rectangular or square. For example, an opening for a door or a window and the like. The substantially rectangular opening can have an aspect ratio with a longitudinal axis that is longer than a traverse axis. The longitudinal axis can be parallel with the closure sliding direction or perpendicular to the sliding direction. The closure slab or panes can have a top and bottom horizontal planes and proximal and distal vertical planes. The vertical distal plane defines the plane closest to the opening frame (in other words, the sill) in the closed position, while the vertical proximal plane defines the planes closest to the opening frame in the open position.

The slab can be opaque or have see-through clarity. "See-through clarity" as used herein refers to an easiness with which a target can be visually recognized through the slab and can be specified by total luminous transmittance and/or parallel luminous transmittance. As used herein, the see-through clarity is described to become lower as the luminous transmittance decreases. "See-through" encompasses any characteristic that allows visual inspection through the slab. Specifically, a viewing window, or the entire slab may be translucent, transparent, or entirely clear. "Translucent" indicates that light can pass through the slab, but the light is diffused. It does not require that a whole surface or an article itself is transparent and portions of the article may be transparent or opaque, for example to serve a function or to form a decorative pattern. The term "translucent" as used herein can refer to a slab composition that transmits at least 60% of electromagnetic radiation in the region ranging from 250 nm to 700 nm with a haze of less than 40%. The slab composition can also have a transmission of at least 75% for example, specifically at least 85%. Additionally, the slab composition can have a haze of less than 40% for example, specifically, a haze of less than 10%, more specifically a haze of less than 5%. The term "translucent" can also refer to a composition capable of at least about 40% transmission of light. The light referred to can be, e.g., actinic light (e.g., from a laser), emitted light (e.g., from a fluorochrome), or both, or transmittance of at least 80%, more preferably at least 85%, and even more preferably at least 90%, as measured spectrophotometrically using water as a standard (100% transmittance) at 690 nm. Likewise, "transparent" refers to a slab composition capable of at least 70% transmission of light.

The opening can be in a wall or defined between structural beams. The opening frame can be coupled to the opening, defining an opening frame, or a sill. For example, the opening frame can be comprised of a horizontal upper support beam, a lower horizontal guide rail and two vertical posts (in other words, jambs). The horizontal upper support beam can be coupled to the opening upper boundary, or to a ceiling beam and the like. The lower horizontal guide rail can be coupled to the floor.

The opening frame, and/or the closure slab frame (in other words, the slab frame and/or the frame surrounding the panes) can be made of the same or different material and can be any appropriate material, for example resin (thermoplastic or thermoset), or wood, or metal, or, for example aluminum or a combination comprising at least one of the foregoing, and/or their composites. Methods of forming the frame or parts thereof can be through extrusion molding, injection molding, thermoforming and the like. Likewise, the opening frame used in motorized closures described can be configured to accommodate a single slab or a plurality of slabs, or panes (slabs and panes are used interchangeably in an embodiment). Also, the closure slab (in other words, a window or a door without the attached frame), can be surrounded by a closure slab or closure pane frame that is configured to receive the motorized driver assemblies described herein. A sliding window, door or the like, as described herein can have at least two panes which extend in a generally vertical plane and at least one of which is movable generally horizontally, an opening frame (in other words, a sill) can include a channel that extends generally horizontally and within which bottom horizontal edge portions of each of the at least two panes are received, a dividing member within the channel which extends between the at least two panes, the dividing member extending either in contact with or in close facing relationship with the bottom edge portions of the at least two panes. The bottom of the channel in the opening frame can further include a rail extending generally horizontally and within which bottom edge portions of each of the at least two panes are engaged and slide upon. In another example, the pane frame can include a complementary channel configured to receive the rail. The pane can for example be an inner pane or an outer pane, referring to the relative position of the panes to the interior of the structure.

The slab or combination of panes, can seal the opening when in the closed position. The term "sealingly" as used herein is to be interpreted as substantially impeding airflow, moisture, particulates and the like through the junction and or opening.

The term "pane" is used principally to embody a glass sheet, which may or may not be a framed sheet. However, the term "pane" is not restricted to glass sheet and may for example include any transparent or opaque material, such as polycarbonate (transparent) or timber (opaque). The term is also intended to encompass double glazed units of two or more sheets of glass or other suitable material. In an embodiment, not all panes are motorized. For example, a closure opening can be closed with three panes have three independent pane frames wherein, only the external and mid panes are motorized with the assemblies, while the internal pane is not motorized. Closure slabs, or panes, motorized with the assemblies described herein can have a weight of up to 400 Kg, for example, between 5.0 Kg to 400 Kg, or 5.0 Kg to 300 Kg, specifically, between 5.0 Kg to 250 Kg, or between 120 Kg and 250 Kg, more specifically between 75 Kg and 200 Kg or between 100 Kg to 220 Kg.

The motorized driver used for sliding the panes along the path in the disclosure provided, can be a DC motor (direct current) or an AC motor (alternating current). The driver (in other words, a mechanical power transfer device) can also be a servo motor, an electric motor, a pneumatic motor and/or any other suitable electrical, mechanical, magnetic or other motor or driver that can apply a torque force upon a drive shaft operably coupled to the motor pulley. The driver can be configured to turn in two directions, namely clock-wise and counter-clockwise. The driver can be coupled to a motor pulley through a shaft. In addition, the mechanical power transfer device can further comprise: a gear box, a clutch (electromagnetic, mechanical, pneumatic or other suitable clutch mechanisms), drive shaft, brackets, and other components capable of assisting in power transfer from a motor to the driver pulley.

A first frame pulley can be concealed in a recess behind the opening frame (e.g., the sill's vertical member horizontally opposite the driver pulley, for example, behind the jamb) and can be a part of an assembly comprising a base, a top flange and a shaft with the first frame pulley being operably coupled to a ball bearing array disposed between the first frame pulley and the top flange and between the first frame pulley and the first frame pulley base. The base can be coupled to a member disposed outside the opening frame, such that, for example, the shaft of the pulley is in parallel with the slab. The opening frame defines an orifice located in front of the frame pulley, allowing for communication between the cable and the frame pulley. The first frame pulley can be disposed for example, at the top or bottom of the opening frame and be aligned with the slab or when a plurality of panes is used, be aligned with each pane. Alternatively, the first frame pulley assembly can be embedded (in other words encased in, covered by, and/or enclosed) entirely within the closure slab frame or the pane frame.

A cable, having a proximal end and a distal end can be coupled at the cable's proximal end to the proximal bottom horizontal side of the slab or pane frame, meaning the side closest to the driver, through a first tension modulator, which can comprise a coupling bracket, a biasing element and a modulating screw capable of modulating the tension on the cable. The cable can loop around the driver pulley (e.g. to minimize slip, see e.g., FIG. 14), extend through an orifice in the opening frame, disposed in front of the driver pulley, wrap around the first frame pulley and operably couple at the cable's distal end to the slab or pane frame, optionally via a second tension modulator assembly. The cable can also loop around the driver pulley (e.g. to minimize slip, see e.g., FIG. 14), extend through an orifice in the opening frame, disposed in front of the driver pulley, wrap around the first frame pulley and operably couple at the cable's distal end directly to the slab or pane frame. Modulating the tension on the cable can be used, for example, to prevent slip (referring for example to the differential in tangential speed of the cable relative to the driver pulley, the first frame pulley and/or the second(ary) frame pulley), of the cable on the driver pulley. The tension modulator can be configured to maintain tension of between about 10 Kilogram force ($Kg_f$) and about 25 ($Kg_f$), system wide—in other words, along the driver-to-frame span, including the various pulleys, or between about 5 ($Kg_f$) and about 13 ($Kg_f$) on the cable itself. The term "cable tension" as used herein refers in an embodiment to the force within the moving wire or cable or cord when the cable is at rest, or static, resulting from the relative positions of two or more pulleys (e.g., driver pulley and frame pulley) or the like to which the cable is coupled (e.g., the frame of pane) in a single direction (e.g., outgoing or returning, see e.g., FIG. 14). In other words the term "tension" does not necessarily include stress and/or force within the cable that is the result of mechanical power transmission (e.g., the motorized driver). Thus, "system wide tension" refers in another embodiment to the same (cable) tension, for a single pane that includes both outgoing and returning cable directions.

The term "looped" means a path along which the cable moves, transit or extends in a cyclic and repetitive fashion, and wherein at least two points on the cable may be designated as occupying the same point or position (on or along the guide path, or along an axis perpendicular to the cable). In addition, the looped path (or track) may be further described as being a closed loop path. Furthermore, "looped" or similar used in the description does not only refer to a perfect circular ring shape, but rather is a general term which encompasses an elliptical ring, a square ring, a polygonal ring shape or the like, to indicate any shape of an object defining a preferable closed region. In addition, the term "wrapped" as used herein, refers to circumstances where the cable is wound around a portion of the circumference of the pulley that is less than the whole circumference.

The slab or panes can be slidably coupled to the opening frame (or, in other words the sill). The driver can be configured to slidably move the panes or slab along the appropriate track on the opening frame (in other words, the sill) at speeds of, for example, between 5.0 to 100 cm/sec., specifically, between 5.0 to 60 cm/sec., or between 5.0 to 30 cm/sec., more specifically, between 5.0 to 25 cm/sec., or between 5.0 to 15 cm/sec. The term "slidably coupled" is used in its broadest sense to refer to elements which are coupled in a way that permits one element to slide or translate with respect to another element.

Likewise, the distal and/or proximal tension modulators described herein can impart a normal operating static load on the tensioned cable that could be, for example, between about 1.0 Kg to 100 Kg, specifically, between about 2.0 Kg to 60.0 Kg, more specifically, between about 4.0 Kg to 15.0 Kg, for example, 5 Kg to 13 Kg for motorized closure assemblies and systems involving cables (outside diameter (od) of 1-4 mm). The normal operating static load imparted by the tension modulator(s) used in the assemblies described herein, can be configured to create a static friction that will not be exceeded during normal operation of the drivers and pulleys provided, thus ensuring no slip will occur between the cable and the pulleys. The ability to modulate the tension using the tension modulator(s) described herein, on the cable, can be beneficial to ensure no slip occurs between the cable and pulleys, as well as to dampen the stress on the cable and the motor's drive shaft following initiation of motion upon receipt of the proper command from a command and control module (CCM) in electronic communication with the driver. Initiation of motion in any of the motorized closure assemblies can be done once the CCM has verified that any locking means are disengaged. For example, a locking means comprising a pin wherein the pin is electromagnetically actuated between a recessed position within the closure slab or pane frame and an open position protruding outside of the closure slab or pane frame, and inserted into the opening frame and/or an adjacent pane frame, can be actuated by the CCM. Prior to initiation of motion of the motorized closure assemblies described, the CCM verifies that the locking pin is in the recessed position, if the pin is in the recessed position, then the motion of the closure slab or pane using the assemblies described herein will be initiated. Else, the pin can be recessed and motion initiated or an alert can be provided to the user.

In another embodiment, provided herein is a motorized closure assembly, comprising: an opening frame configured to fit around at least the top horizontal side, a distal vertical side, and a bottom horizontal side of a substantially rectangular opening; a substantially rectangular closure slab having a closure slab frame configured to surround the substantially rectangular closure slab and sealingly fit within the opening frame; a driver, the driver embedded within a proximal (e.g., to the drive motor) vertical side of the substantially rectangular closure slab frame and coupled to a driver pulley; a frame pulley, can be embedded within and coupled to a distal horizontal side of the substantially rectangular closure slab on a horizontal side opposite the driver pulley. The driver pulley and the first frame pulley can be disposed such that both are on the same level, while the driver body extends above the driver pulley. A first free pulley can be disposed between the driver pulley and the first frame pulley and operably coupled to the closure slab frame. Depending on the span of the bottom horizontal side of the closure slab frame or the pane frame, and/or the weight of the closure slab frame or the pane frame, more than one free pulleys can be employed. In addition, a cable can connect the motor pulley, the first free pulley and the frame pulley, wherein the cable and the free pulley are embedded within the closure slab frame (e.g., the lower horizontal side of the closure slab frame or the pane frame).

Upon receipt of command from the CCM, the driver can be activated to turn the driver pulley (e.g., the motor pulley) either clockwise or counterclockwise turning the driver pulley in a corresponding direction, causing the cable to rotate the first free pulley, coupled to the closure slab or closure pane frame, rotate the track wheel, thereby causing the slab or pane to slidably move from an open to closed position or from a closed to an open position. In a specific example, the cable can loop around at least a second free pulley as described herein. The skilled artisan will recognize, that the number of free pulleys used in the motorized closures described herein, can depend on, for example, the span of the opening, the weight of the closure slab, the size of the driver, the available packaging space within the closure slab frame, or a combination comprising at least one of the foregoing.

The cable can be made of any material appropriate for the necessary tension. The use of cable described indicates that the cable be able to survive high tensile loading. The closing and opening motion of the closures described may require that the umbilical or tether cable provide for the bi-directional motion. It may be beneficial to have innate low elongation characteristics, preventing the fibers of the cable from stretching, hence the need for low elongation, high tensile strength fibers. The cable can, for example be a high strength stainless or galvanized steel rope for that purpose. Alternatively, the cable can be made of Kevlar (in other words, a para-aramid synthetic fiber) or Vectran (an aromatic polyester produced by the polycondensation of 4-hydroxybenzoic acid and 6-hydroxynaphthalene-2-carboxylic acid), or Technora (condensation polymerization of terephthaloyl chloride (TCl) with a mixture of p-phenylenediamine (PPD) and 3,4'-diaminodiphenylether (3,4'-ODA)) and the like ropes and braided fibers having an elongation of no more than 10%. With proper placement in the cable and suitable termination or anchoring techniques the rope can provide a dual role. The cable diameter can be between 1 and 5 millimeter for example, having a breaking strength of between 50 and 1000 Kg, and can be sheathed (in other words jacketed) in a resin to increase the friction between the cable and the driver pulley and the frame pulley.

A more complete understanding of the components, processes, assemblies, and devices disclosed herein can be obtained by reference to the accompanying drawings. These figures (also referred to herein as "FIG.") are merely schematic representations (e.g., illustrations) based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Turning now to FIGS. 1-9, showing, in FIG. 1, a side view of opening frame 100 where each of three panes; internal pane 103, mid pane 102, and external pane 101 are enclosed by pane frame. Cut-aways point to corresponding detailed drawings in FIGS. 2B, 5 and 8 with section A-A illustrated in detail in FIG. 4.

FIG. 2A, illustrates a bottom view of opening frame 100 shown in FIG. 1 indicating the location of the frame pulleys (right, FIG. 2B) and driver pulley base (Left, not indicated). FIG. 2A shows the base 481 of first frame pulley 480 (not marked) assembly (see e.g., FIG. 9C) where each first frame pulley assembly is aligned with the track corresponding to the pane sought to be moved (e.g. frames 102 and 103). As shown in FIG. 1, not all panes must be motorized and only panes 102 and 103 are motorized. Pane 101 can, for example, by static or mobilized manually and be a sliding door or a pivoting door (or both sliding and pivoting).

Figure 2C:
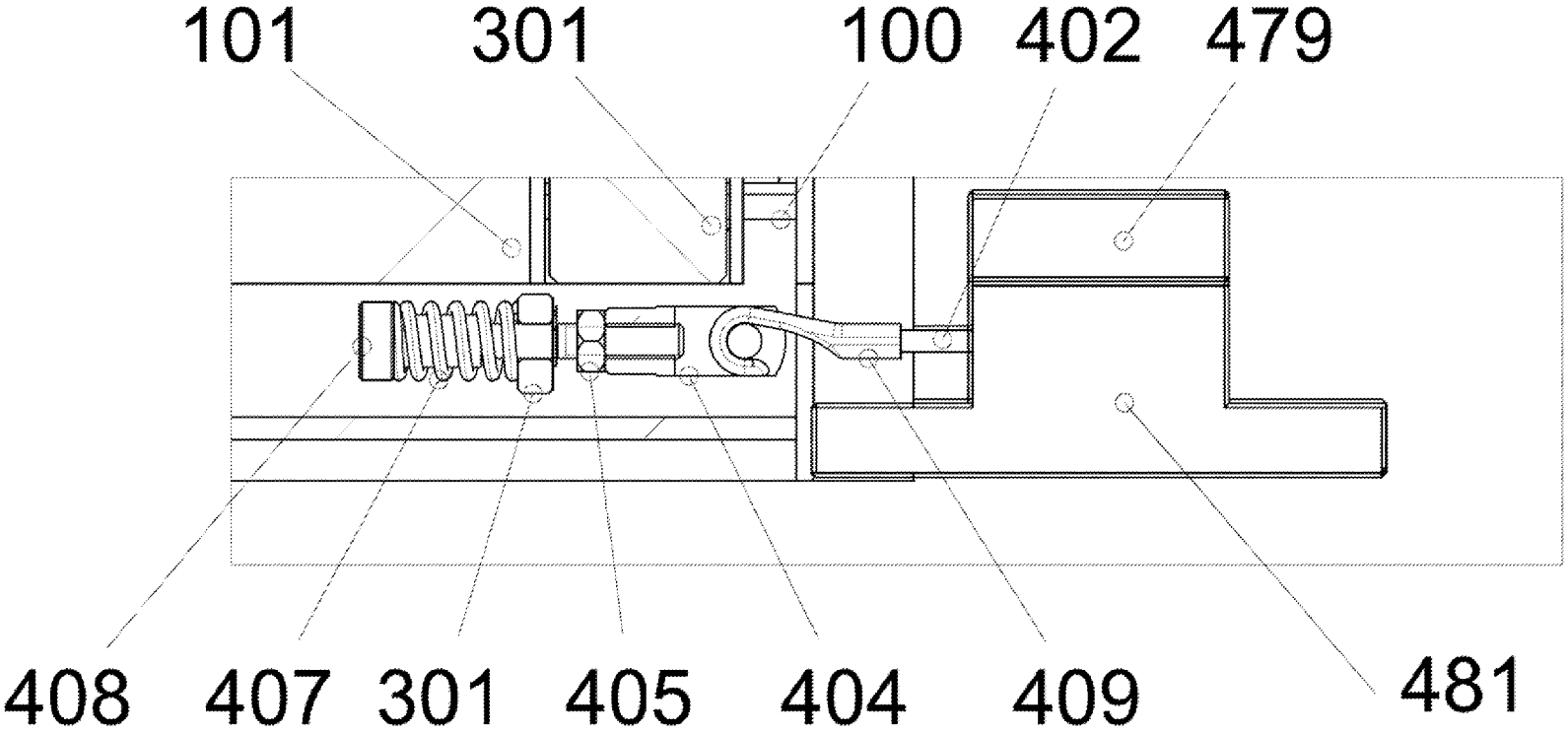

Turning now to FIG. 2C, showing the proximal coupling of pane frame 102 to first frame pulley 480 (not shown) enclosed between first frame pulley base 481 and first frame pulley top flange 479 connected to tension modulator assembly. The tension modulator assembly can comprise, for example, back screw 408 coupled to cable 402 through an orifice defined in coupling bracket 301 with biasing element 407 disposed between the coupling bracket and the head of back screw 408, the back screw being coupled (for example by a threading) to socket (e.g. a Spelter socket) 404 with optionally a locking bolt 405 limiting the movement of back screw 408 in relation to socket 404. Plug 409 shown as well.

Figure 3A:
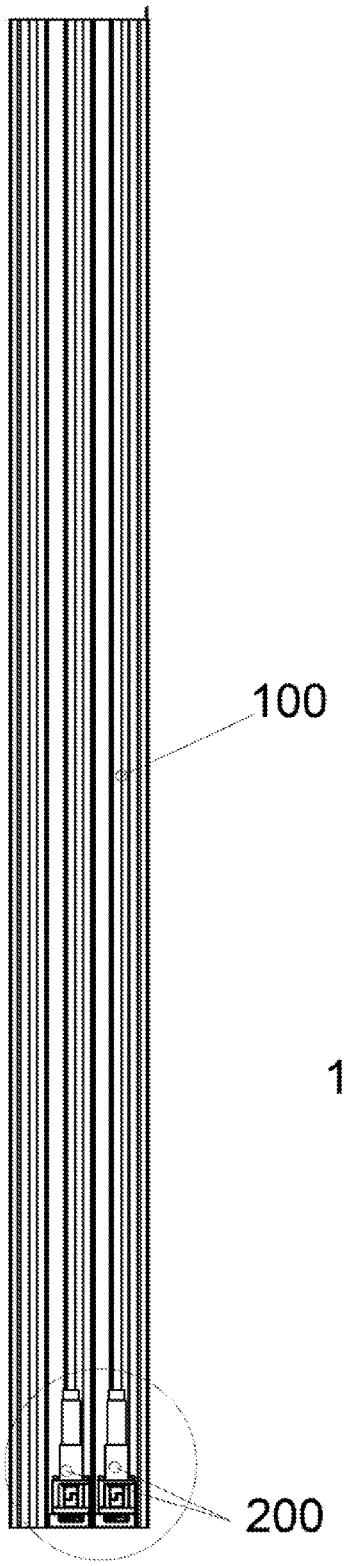
FIG. 3A-3C, FIG. 3A shows an illustration of the driver according to an embodiment of the technology.
Figure 3B:
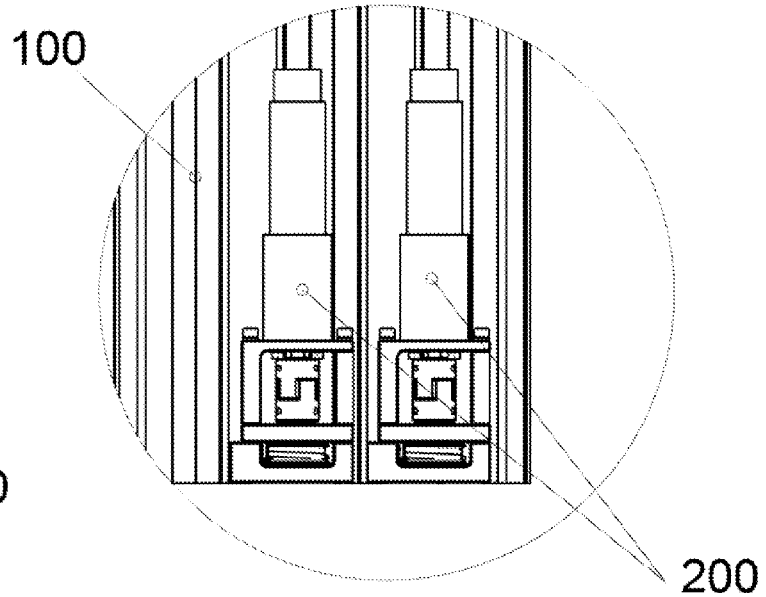
Figure 3C:
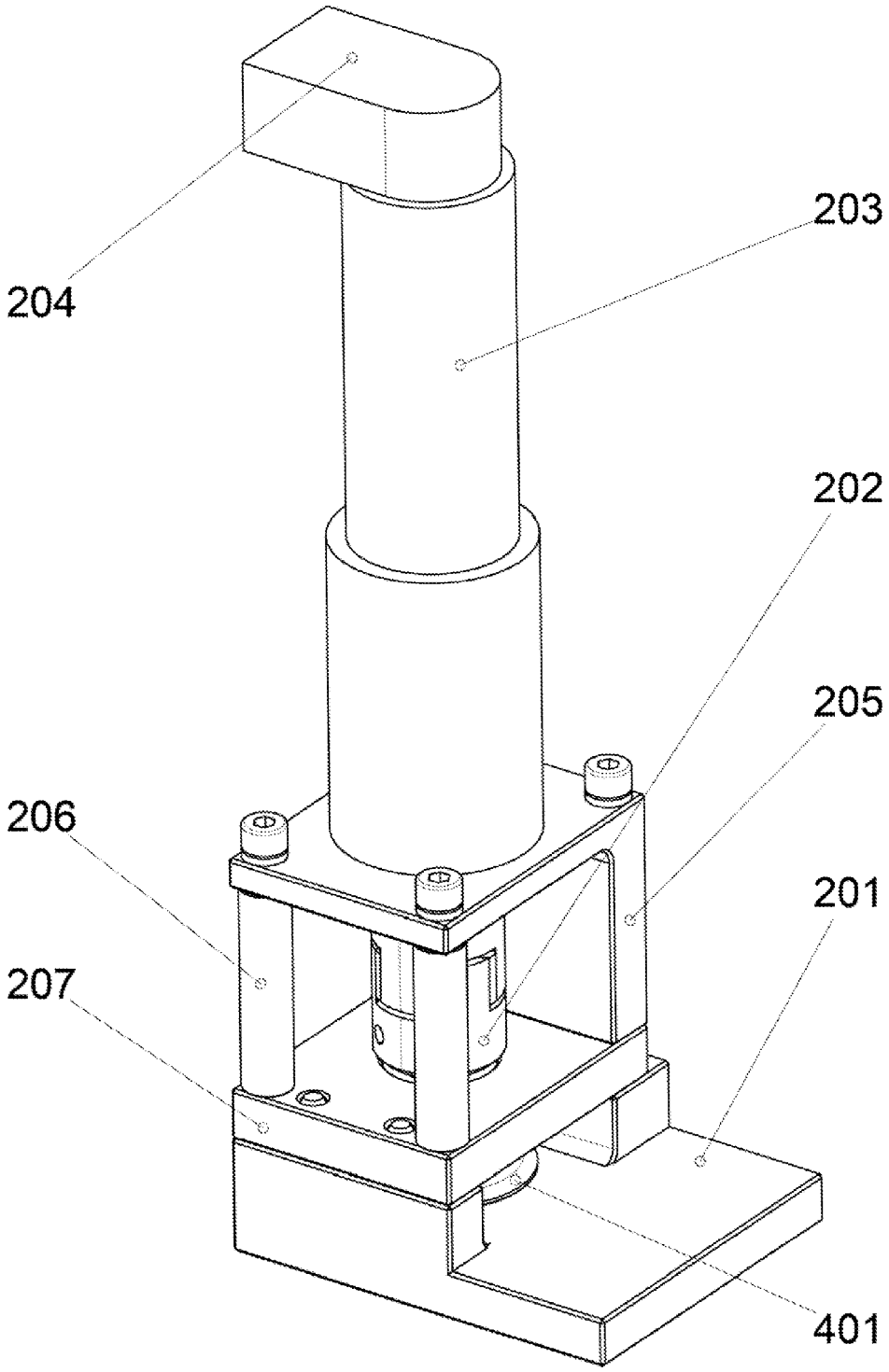

Turning now to FIG. 3A, showing rear view of the proximal vertical post of opening frame (e.g., sill) 100 with drivers 200 aligned in a recess in the structural wall for example, with the pane or slab (e.g., 102 and 103) sought to be mobilized or motorized (FIG. 3B). Driver motor 200 is shown in FIG. 3C, with driver pulley 401 assembly having driver pulley base 201 connected to driver pulley assembly's top flange 207, housing driver pulley 401 and optionally a bearing array (not shown) disposed between driver pulley 401 and top flange 207, and between driver pulley 401 and driver pulley base 201. The shaft of driver pulley 401 extends above driver pulley assembly's top flange 207, optionally terminating in coupling assembly 202 having a bottom member operably coupled to driver pulley 401 and a top member coupled to driver motor 203 which is coupled to planetary gear box 220, which in turn, can be coupled to driver pulley assembly's top flange 207 via driver bracket 205 and spacers 206. Electric connection leads 204 are shown with cover. Planetary gear box can have, for example a 1:1 to 1:7 transmission ratio from motor 203 drive shaft to driver pulley 401. Coupling assembly 202 can be replaced, for example with an electromagnetic clutch (not shown, see FIG. 3C). Alternatively, pulley 401 can be driven directly by drive shaft extending from planetary gear box 220 and no coupling assembly is involved.

Figure 4:
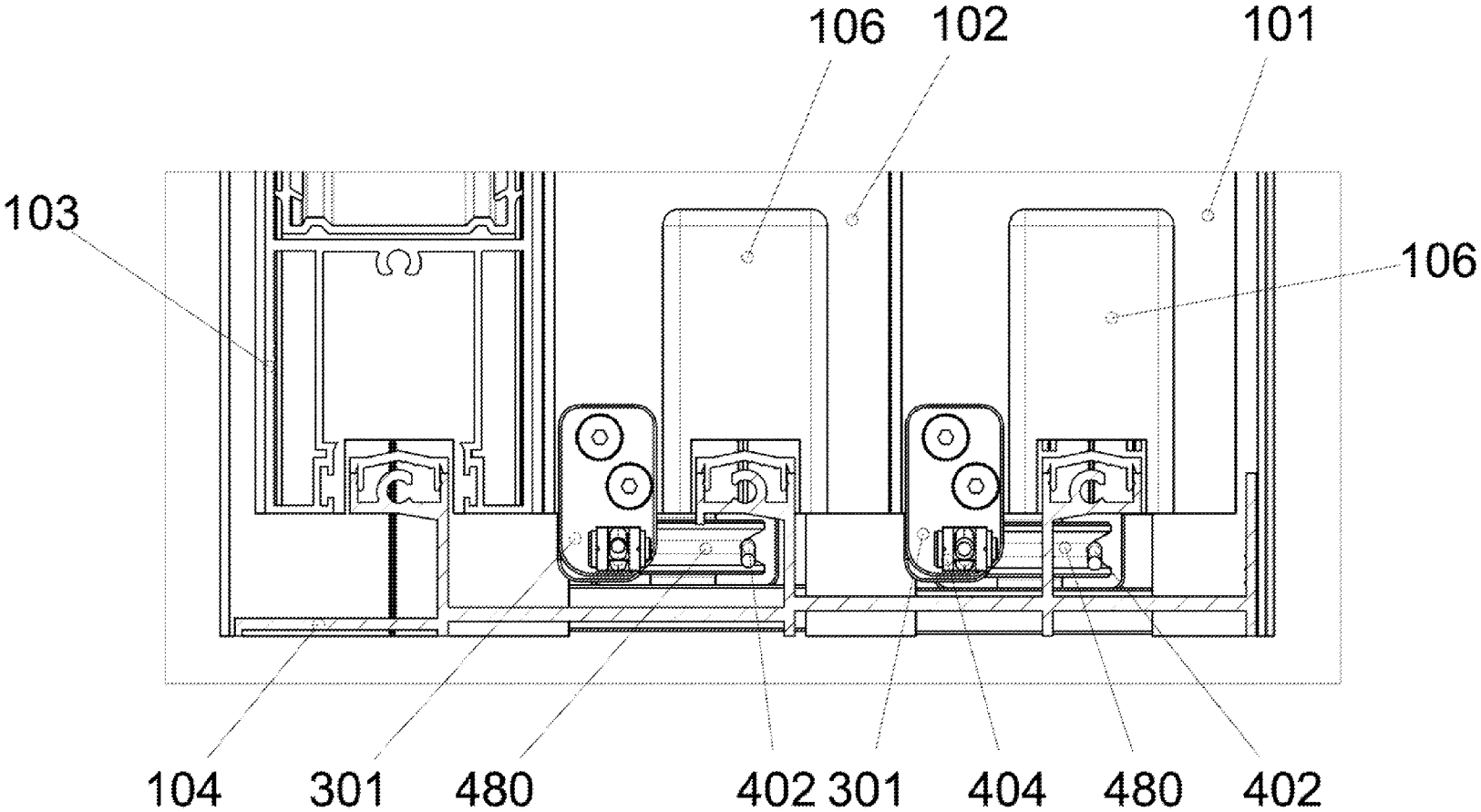
FIG. 4 shows an illustration of section A-A from FIG. 1 according to an embodiment of the technology.

Turning now to FIG. 4, showing FIG. 1 section A-A, with sill 100 defining channels where internal pane frame 103 is operably coupled to cable 402 wrapping around first frame pulley 480 and attached to coupling bracket 301 with socket 404. As shown, cover 106 partially cover orifice defined in pane 103 frame. Cover 106 can be removed when necessary to facilitate access to tension modulator screw 408 (e.g., FIG. 2C) to adjust tension on cable 402, access first frame pulley 480 or other components of the assembly described herein. Sill 100 has a bottom profile 104 defining channels dividers and rails facilitating the slidable coupling of the pane frame and its motion.

Figure 5:
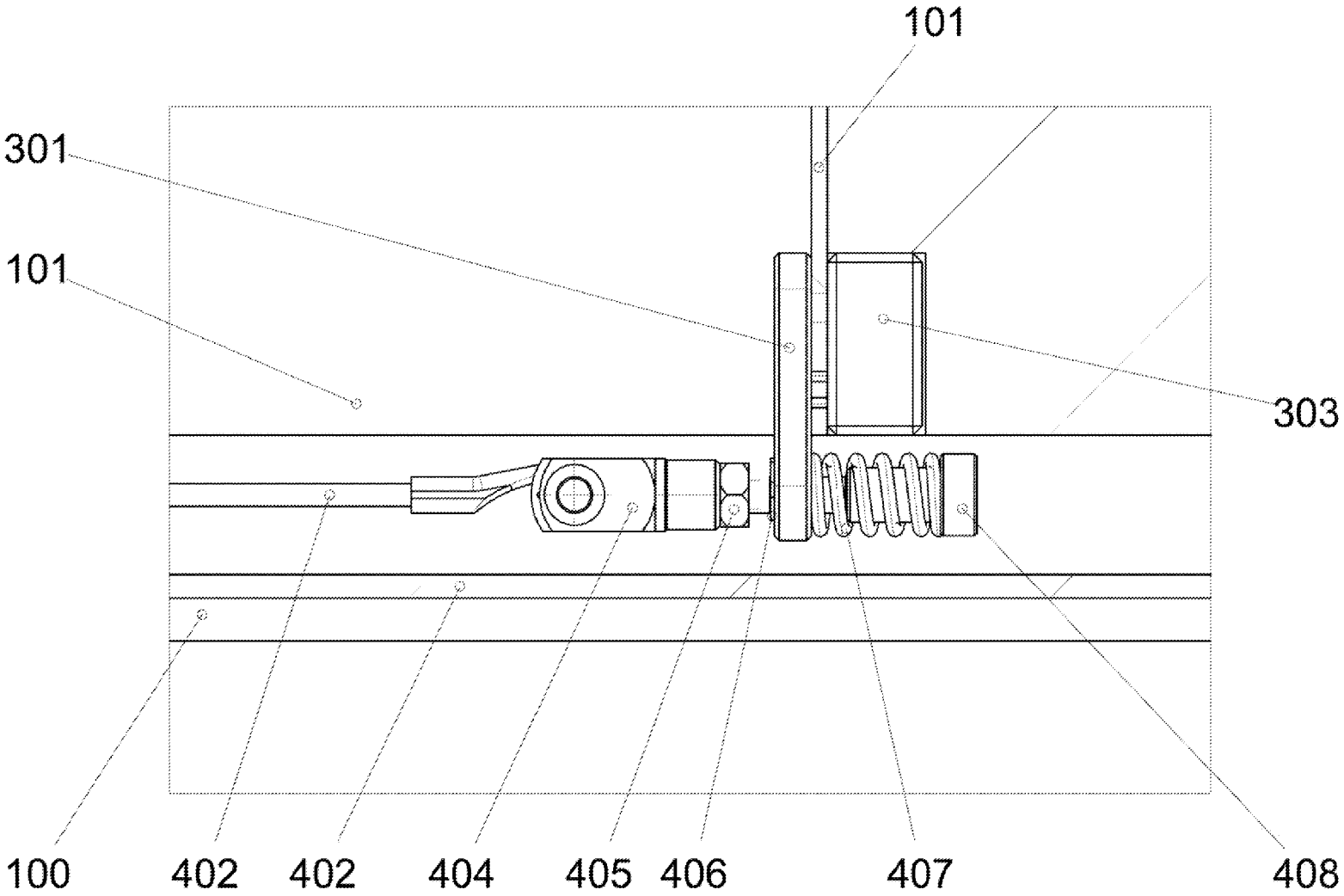
FIG. 5 shows an illustration of the coupler of the cable tension modulator to the closure frame according to an embodiment of the technology.

Turning now to FIG. 5, showing the distal cable end coupling of cable 402 to pane frame 103, with coupling bracket 301 coupled to coupling bracket backing 303, C-clamp 406 can be used to restrict movement of back screw 408. Closure slab frame 103 (as well as frames 102 and 101) can have thickness of between 0.5 to 3 mm and can have fixed or variable thickness along the frame. Pane frames 102, and 103 can be similarly dimensioned or can have different thickness. As shown, back screw 408 can be coupled to cable 402 through an orifice defined in coupling bracket 301 attached through pane frame 103 to coupling bracket backing 303, with biasing element 407 disposed between coupling bracket 301 and the head of back screw 408, the back screw 408 being coupled (for example by a threading) to socket (e.g. Spelter socket) 404 with optionally a locking bolt 405 limiting the movement of back screw 408 in relation to socket 404. Cable 402 can be looped around driver pulley 401 (not shown), extending to proximal end as shown in FIG. 2B, wrapping around first frame pulley 480 (not shown).

Figure 6:
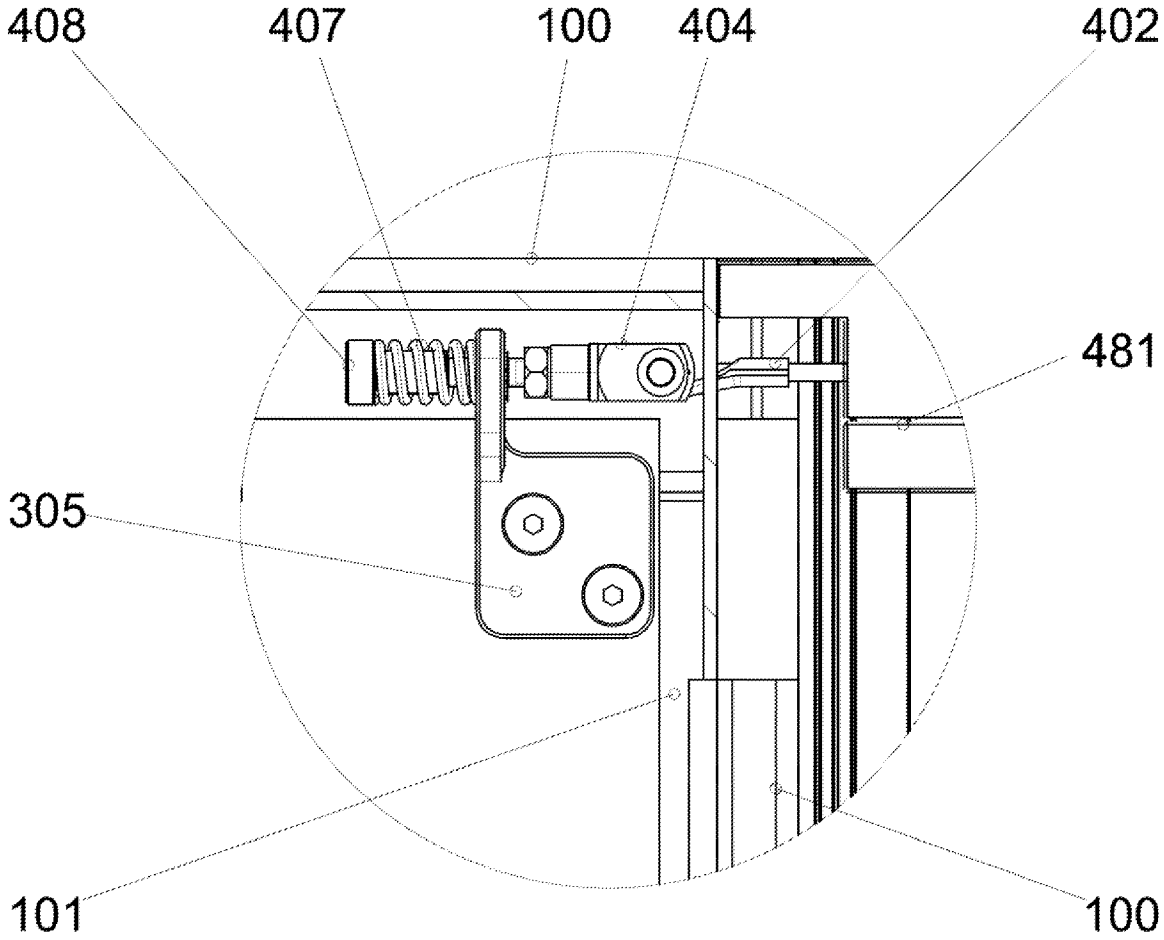
FIG. 6, shows an illustration of the coupler of the cable tension modulator to the closure frame in relation to the first frame pulley disposed on the top of the closure slab according to an embodiment of the technology.
Figure 7:
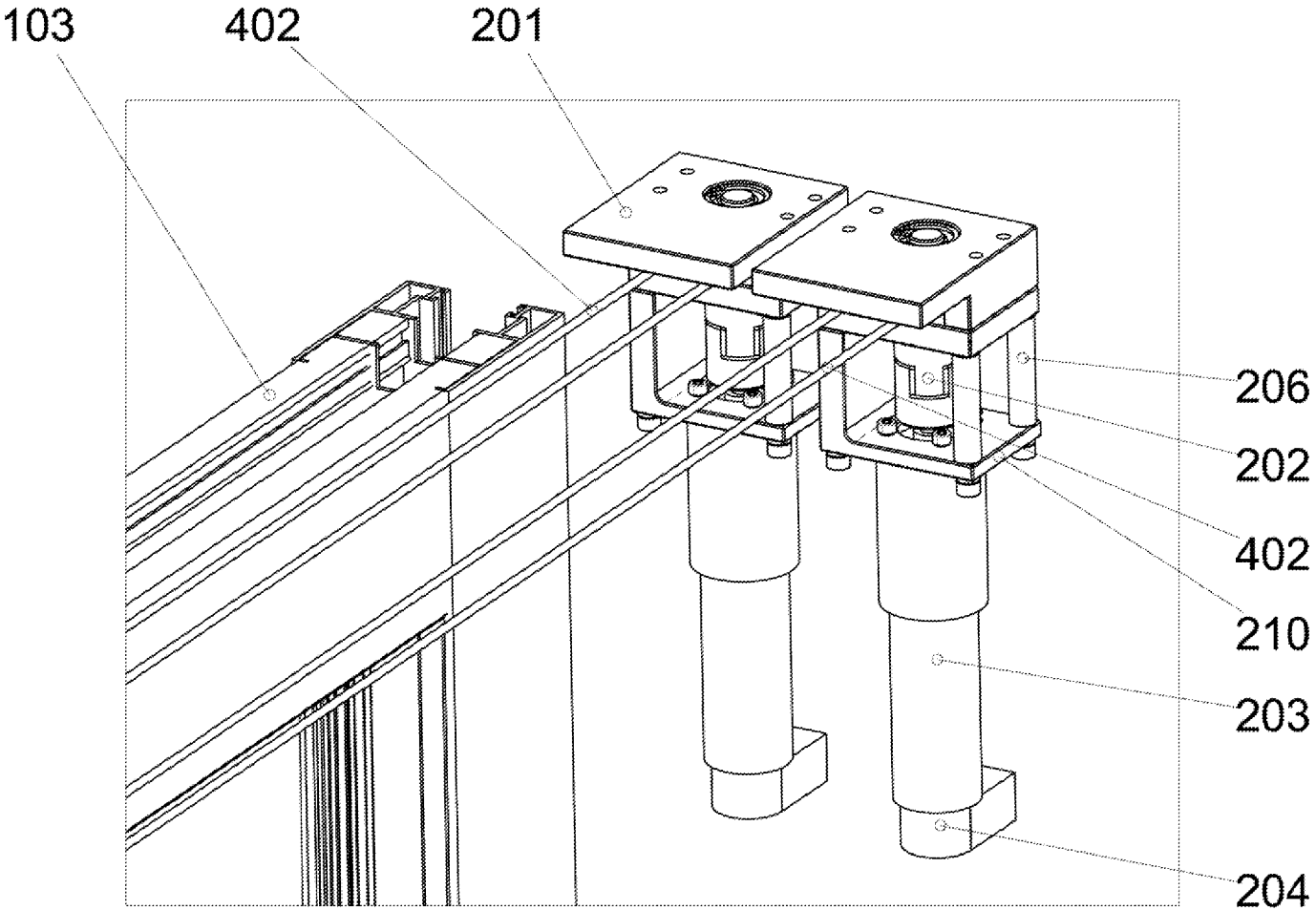
FIG. 7 show an illustration of the driver in relation to the closure slab frame according to an embodiment of the technology FIG. 8 show an illustration of the driver in relation to the closure slab frame according to another embodiment of the technology.

FIGS. 6 and 7 show a configuration (see e.g., FIG. 6) where driver pulley assembly base 481 is coupled to closure pane frame 103 with proximal cable coupling that can be coupled to tension modulator assembly comprising back screw 408 coupled to cable 402 through an orifice defined in top coupling bracket 305 with biasing element 407 disposed between the top coupling bracket 305 and the head of back screw 408, the back screw being coupled (for example by a threading) to socket (e.g. Spelter socket) 404.

The term "biasing element" or "coupled biasing" refers to any element that provides a biasing force. Representative biasing elements include but are not limited to springs (e.g., elastomeric or metal springs, torsion springs, coil springs, leaf springs, tension springs, compression springs, extension springs, spiral springs, volute springs, flat springs, and the like), detents (e.g., spring-loaded detent balls, cones, wedges, cylinders, and the like), pneumatic devices, hydraulic devices, magnets, and the like, and combinations thereof. Likewise, "biasing element" as used herein refers to one or more members that apply an urging force between two elements, for example, urging pane frame 101 away from top coupling bracket 305.

Turning now to FIG. 7, showing the driver configuration opposite FIG. 6, where driver 200 showing inverted configuration of driver pulley 401 (not shown) assembly having driver pulley base 201 connected to driver pulley assembly's top flange 207 (not shown), housing driver pulley 401. The shaft of driver pulley 401 extends below driver pulley assembly's top flange 207 (not shown), terminating in coupling assembly 202 having a bottom member operably coupled to driver pulley 401 and a top member coupled to driver motor 203 which is coupled to planetary gear box 220, which can be coupled to driver pulley assembly's top flange 207 (not shown), via driver bracket 205 and spacers 206. Electric connection leads 204 are shown with cover. As shown, the motorized closure assembly can be on the same level (e.g., top horizontal or bottom horizontal sides of the frame) or at opposite levels for each pane. Accordingly, in a specific example, the driver assembly is not in the same relative location as the driver assembly of the adjacent pane.

Figure 8:
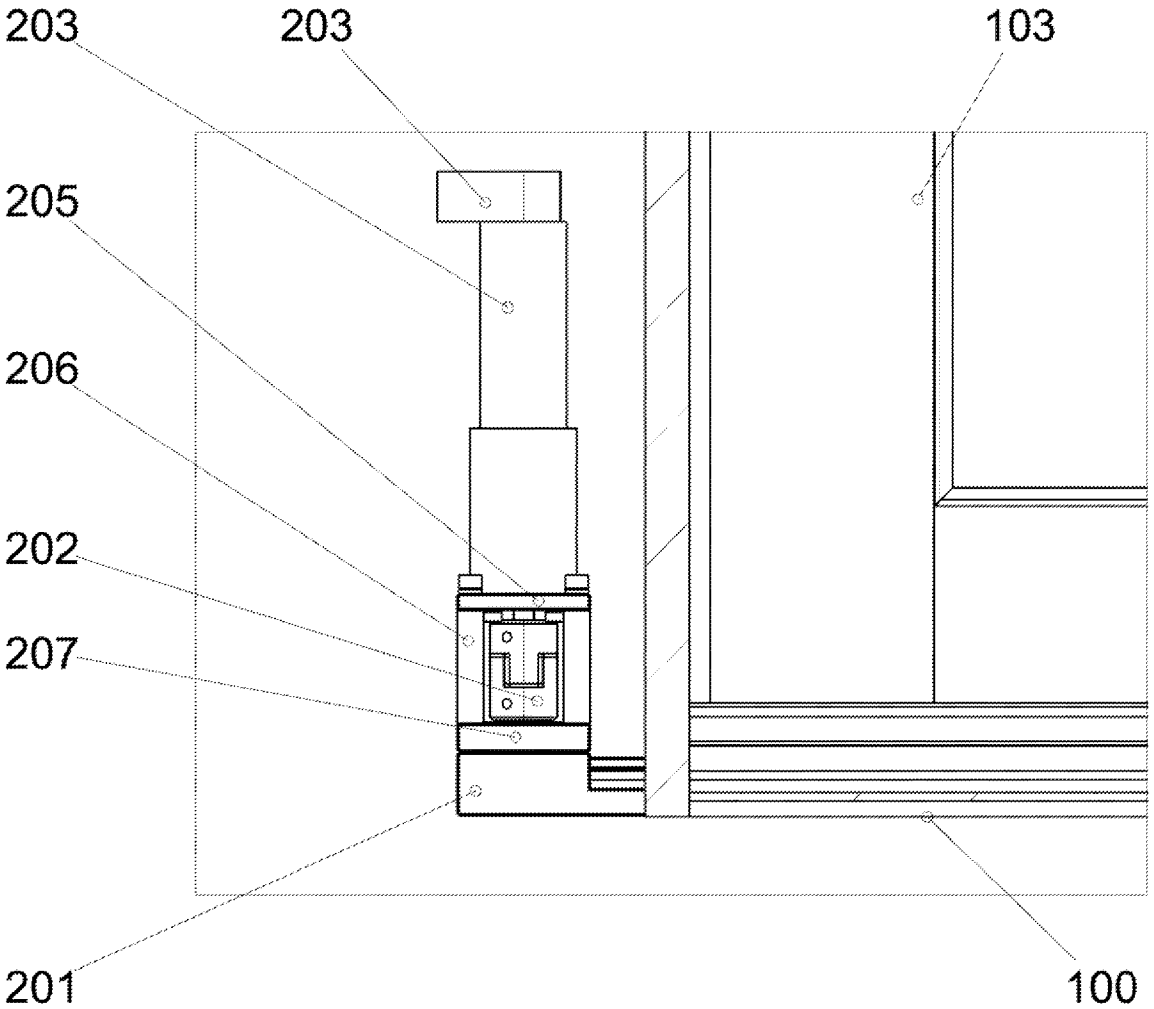

FIG. 8. illustrates the relative configuration in a side view, of driver 200 recessed behind opening frame (sill) 100, showing driver pulley 401 assembly having driver pulley base 201 connected to driver pulley assembly's top flange 207, housing driver pulley 401 (not shown), and optionally a bearing array (not shown). The shaft of driver pulley 401 extends above driver pulley assembly's top flange 207, terminating in coupling assembly 202 having a bottom member operably coupled to driver pulley 401 and a top member coupled to driver motor 203 which is coupled to planetary gear box 220, which can be coupled to driver pulley assembly's top flange 207 via driver bracket 205 and spacers 206. Electric connection leads 204 are shown with cover. FIG. 8 further illustrates the location of cable 402 embedded within the horizontal bottom side of the closure slab frame or the pane frame, thus being concealed.

Figure 9C:
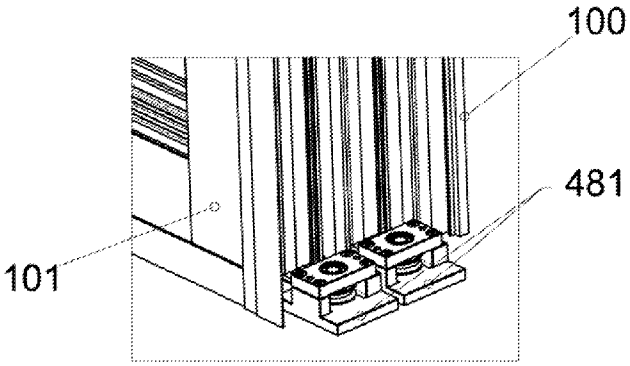
FIGS. 9B and 9C show an opening defined in the opening frame and FIG. 9D shows the first frame pulley assembly.
Figure 9B:
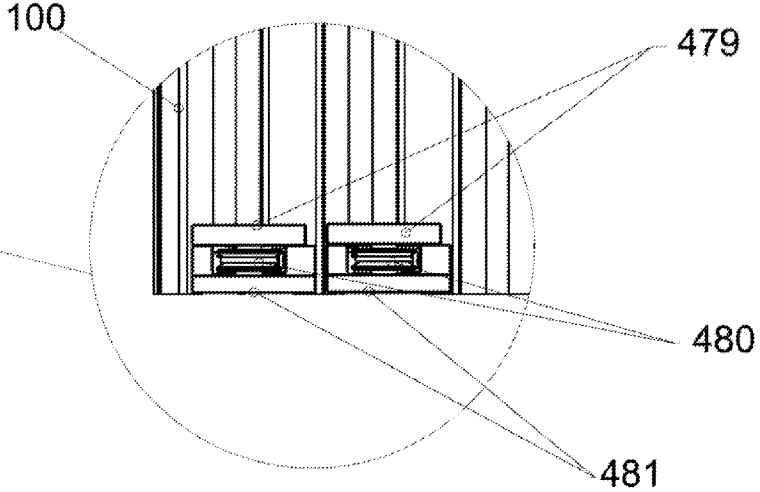
Figure 9A:
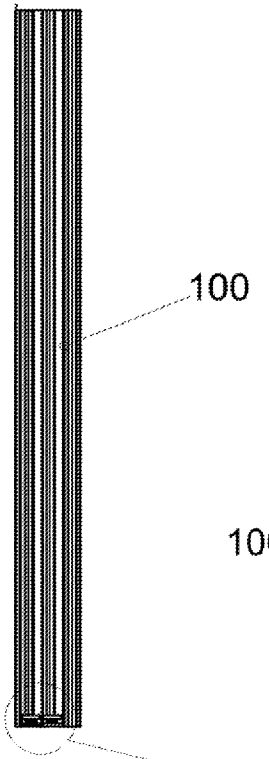
FIG. 9A shows an illustration of the first frame pulley assembly, where
Figure 9D:
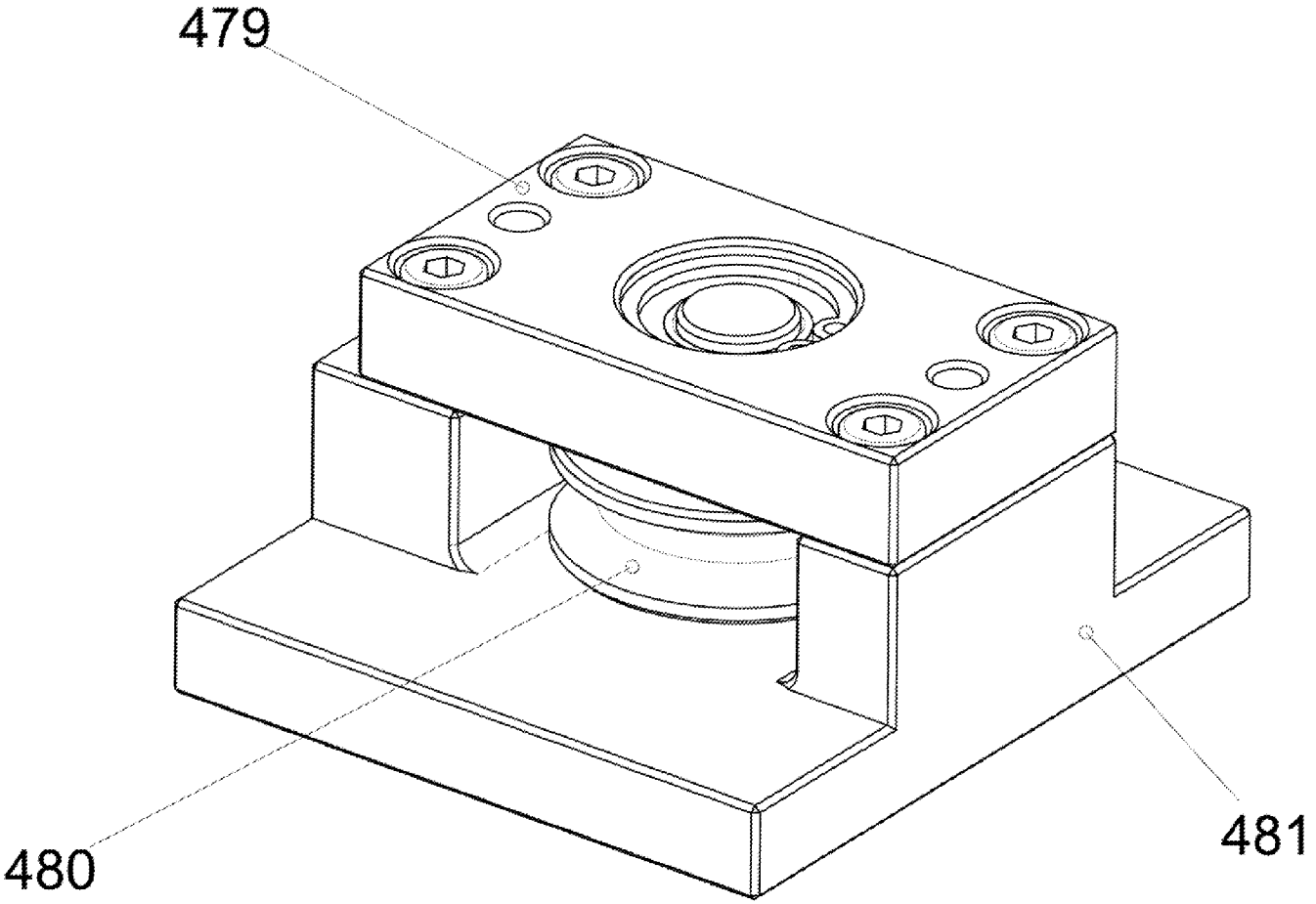

Turning to FIG. 9A, showing front view of FIG. 1, where FIGS. 9B (front view, enlarged) and 9C (isometric view) illustrate the space defined in the distal vertical post of the opening frame (e.g., jamb) 100 creating the communication between first frame pulley 480 and closure pane frame 103, 102. Where as shown in FIG. 9D, first frame pulley 480 is sandwiched between base 481 and first frame pulley assembly's top flange 479, which can optionally comprise ball bearing array between first frame pulley 480 and base 481, and between first frame pulley 480 and first frame pulley top flange 479.

Figure 10:
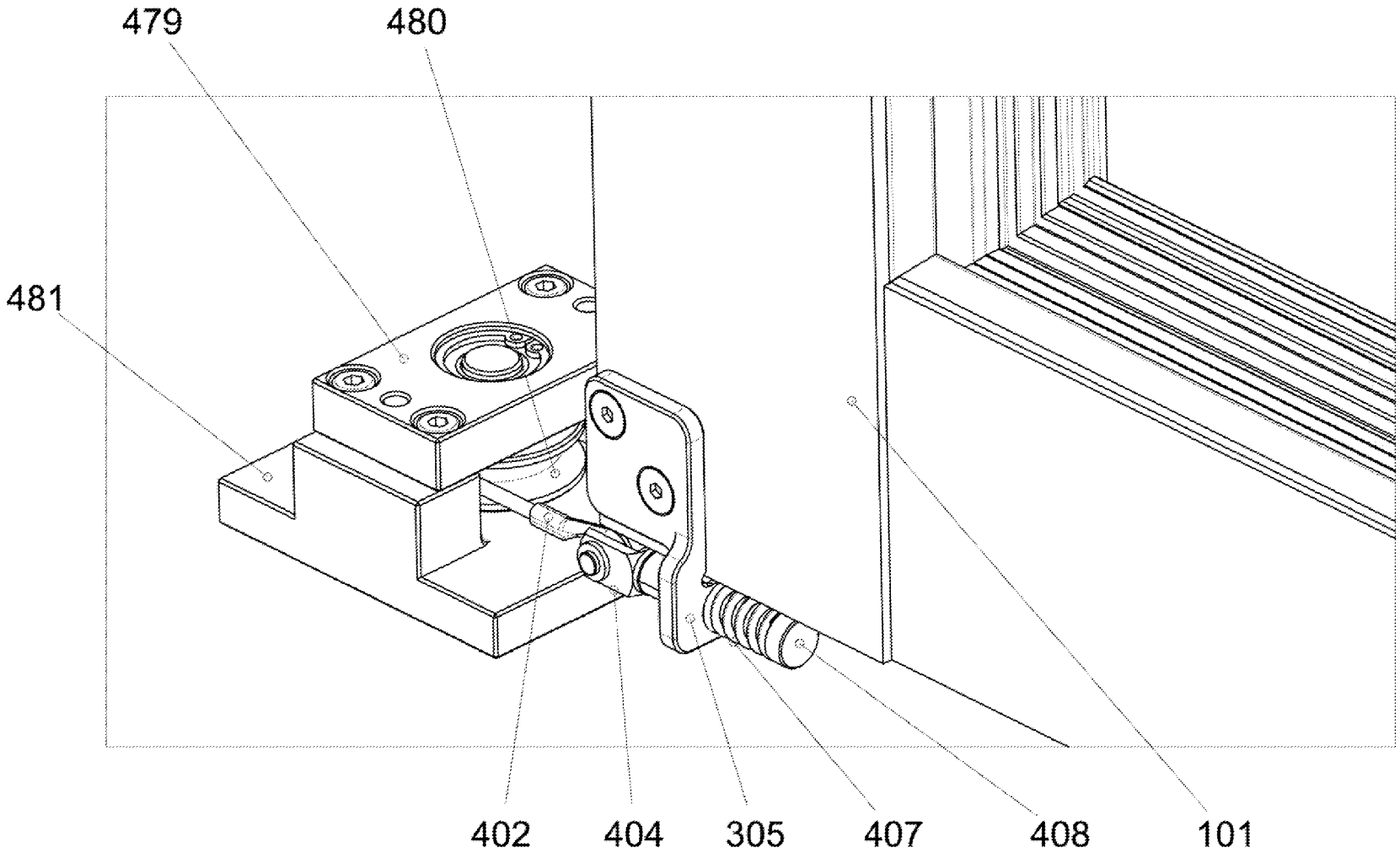
FIG. 10 shows an illustration of the cable coupling the first frame pulley assembly and the tension modulator coupling to the closure slab frame at the bottom of the closure slab frame in a top right isometric view.
Figure 11:
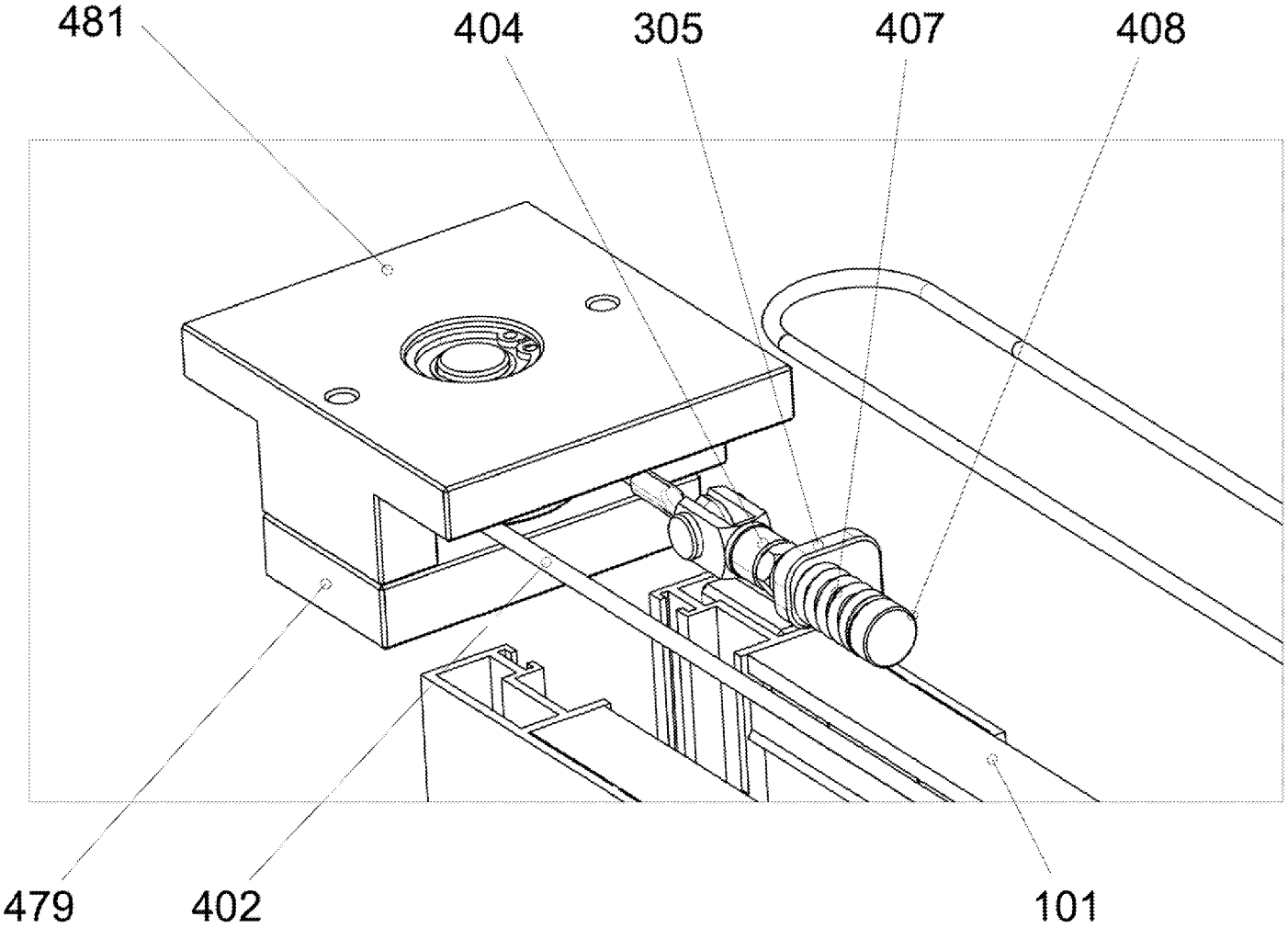
FIG. 11 show an illustration of the cable as a bottom view of the closure slab frame.

Turning now to FIGS. 10-13, showing an example of the configuration of coupling of cable 402 to pane frame 102. As shown in FIG. 10, the proximal coupling of pane frame 102 to first frame pulley 480 enclosed between first frame pulley base 481 and first frame pulley top flange 479 connected to tension modulator assembly, the assembly comprising, for example, back screw 408 coupled to cable 402 through an orifice defined in bottom coupling bracket 305 with biasing element 407 disposed between the coupling bracket and the head of back screw 408, the back screw being coupled (for example by a threading) to socket (e.g. Spelter socket) 404. As shown, cable 402 can be wrapped or be partially wound around pulley 480. Likewise, FIG. 11 shows a bottom isometric view of FIG. 10, showing proximal cable end coupling of pane frame 103 to first frame pulley 480 enclosed between first frame pulley base 481 and first frame pulley top flange 479 connected to tension modulator assembly, the assembly comprising, for example, back screw 408 coupled to cable 402 wrapping around first frame pulley 480 through an orifice defined in bottom coupling bracket 305 with biasing element 407 disposed between the coupling bracket and the head of back screw 408, the back screw being coupled (for example by a threading) to socket (e.g. Spelter socket) 404. Illustrated as well, is the cable configuration of pane 102 around first frame pulley 480 associated therewith (not shown for clarity, illustrating the wrapping of cable 402)

FIG. 12 shows distal cable end coupling of cable 402 to pane frame 103, with coupling bracket 301 coupled to coupling bracket backing 303 (not shown), C-clamp 406 can be used to restrict movement of back screw 408 (not shown). As previously indicated, back screw 408 can be coupled to cable 402 through an orifice defined in coupling bracket 301 attached through pane frame 103 to coupling bracket backing 303 (not shown), with biasing element 407 (not shown), disposed between coupling bracket 301 and the head of back screw 408, the back screw 408 being coupled (for example by a threading) to socket (e.g. Spelter socket) 404 with optionally a locking bolt 405 limiting the movement of back screw 408 in relation to socket 404. As shown, cable 402 is wrapped around driver pulley 401 (not shown), extending to proximal end as shown in FIG. 2B, wrapping around first frame pulley 480 (not shown) and covered by cover 106.

Figure 13:
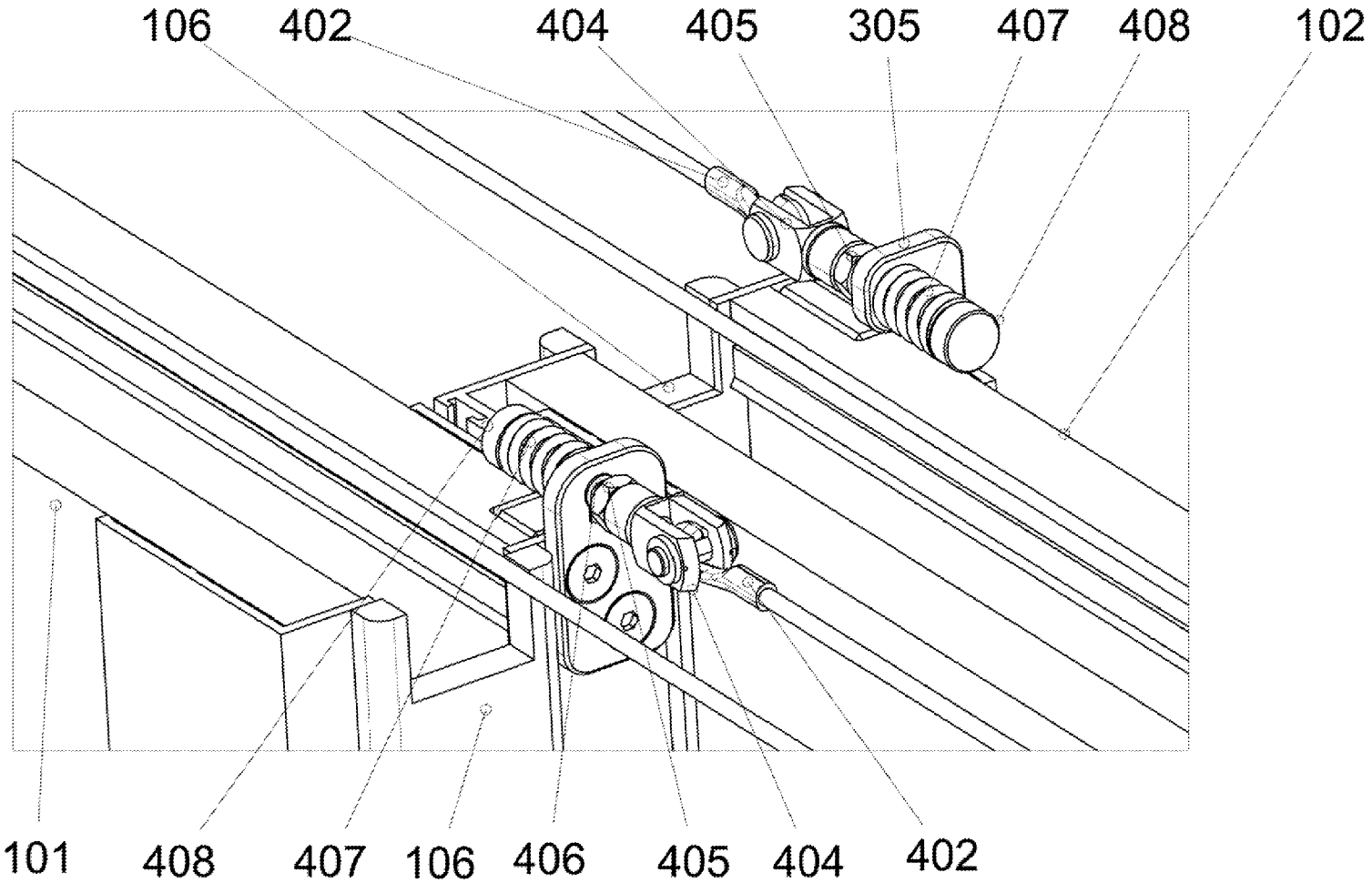
FIG. 13, shows an illustration of an internal and external pane cable coupling to a tension modulator and assembly covering according to an embodiment of the technology.

FIG. 13, shows a bottom isometric view of FIG. 12, removing for clarity opening frame 100. FIG. 13 illustrates distal cable end coupling of cable 402 to pane frame 103, with coupling bracket 301 coupled to coupling bracket backing 303 (not shown), C-clamp 406 can be used to restrict movement of back screw 408. As previously indicated, back screw 408 can be coupled to cable 402 through an orifice defined in coupling bracket 301 attached through pane frame 103 to coupling bracket backing 303 (not shown), with biasing element 407, disposed between coupling bracket 301 and the head of back screw 408, the back screw 408 being coupled (for example by a threading) to socket (e.g. Spelter socket) 404 with optionally a locking bolt 405 limiting the movement of back screw 408 in relation to socket 404. As shown, cable 402 is wrapped around driver pulley 401 (not shown), extending to proximal end as shown in FIG. 2B, wrapping around first frame pulley 480 (not shown) and covered by cover 106.

Likewise proximal cable end coupling of cable 402 to pane frame 102, with coupling bracket 303 coupled to pane frame 102. As previously indicated, back screw 408 can be coupled to cable 402 through an orifice defined in coupling bracket 305 attached to pane frame 102, with biasing element 407, disposed between coupling bracket 305 and the head of back screw 408, the back screw 408 being coupled (for example by a threading) to socket (e.g. Spelter socket) 404 with optionally a locking bolt 405 limiting the movement of back screw 408 in relation to socket 404. As shown, cable 402 is wrapped around first frame pulley 480 (not shown), extending to distal end, wrapping around first frame pulley 480 (not shown) and covered by cover 106.

FIG. 14, illustrates an embodiment with double marine pulley arrangement. It is noted that platform 1400 having proximal platform bracket 1410 and distal platform bracket 1420 can house in one embodiment first frame pulley 480 and secondary frame pulley 490 (or 480' and 490' respectively for adjacent pulley system associated with adjacent pane and similarly, for 1400', 1410' and 1420' respectively); and in another embodiment driver pulley 401 (not shown, see e.g., FIG. 3B) and secondary driver pulley 410 (not shown, equivalent to frame pulley 490).

Platform 1400 can be configured to carry driver pulley 401 (see e.g., FIG. 3B), driver 200 and secondary driver pulley 410 and be slidably coupled to closure frame 102, 101, for example via a screw gear, thereby operating as a tension modulator. In this configuration, driver 200 (see e.g., FIG. 3B) can be operably coupled to shaft 483. In those embodiments where platform 1400 is slidably movably coupled to closure frame 101, 102, cable 402 distal end coupling to frame 101, 102, is not using a biasing element.

Similarly, platform 1400 can be configured to carry first frame pulley 480 and secondary frame pulley 490 and wherein the proximal coupling of pane frame 102 (not shown, see e.g., FIG. 10) to first frame pulley 480 enclosed between distal platform bracket 1410 and proximal platform bracket 1420 on platform 1400. As illustrated, cable 402 can be looped around pulley 480 and then be looped around secondary pulley 490 with shaft 493, operably coupled to (optionally movable) platform 1400.

As illustrated, in an embodiment when platform 1400 operates as the tension modulator, the whole assembly can be coupled to pane 102 directly, without the use of coupling bracket(s) (e.g., 301, 305, see e.g., FIGS. 12 and 13), for example, using a screw (caterpillar) drive.

Further, cable 402 can be wrapped or be partially wound around pulley 480 and 490. Also shown in the proximal coupling of pane frame 101 (not shown, see e.g., FIG. 1) to frame pulley 480 enclosed between distal platform bracket 1410 and proximal platform bracket 1420 on platform 1400. Accordingly, cable 402 can be looped around pulley 480 and then be looped around secondary pulley 491 with shaft 493, operably coupled to platform 1400. As also illustrated, in an embodiment the tension modulator assembly can be coupled to pane 101 directly, without the use of coupling bracket(s) (e.g., 301, 305, see e.g., FIGS. 12 and 13).

As illustrated, shafts 493 of secondary frame pulley 490 and 491, are offset from shaft 483, along a longitudinal axis of the horizontal guide rail 105 (see e.g., FIG. 12), or platform 1400 when carrying driver 200, driver pulley 401 and secondary driver pulley 410, thus allowing cable 402 to loop and return entirely embedded within pane frame 102, 101, while using a single tension modulator. The distance between the outgoing end returning cables can be, for example, between 2 and 5 mm, adapted by the offset of the pulley shafts on platform 1400. Further, looping the cable as illustrated such that the outgoing and returning cables are on the same side of pane(s) 101, 102, can be beneficial in reducing slip and ensuring the cables and the whole system is invisible regardless of the pane position between closed and open position on frame rail 105.

In an embodiment, provided herein is a motorized opening assembly, comprising: an opening frame configured to fit around the opening; a substantially rectangular closure slab having a closure slab frame configured to surround the substantially rectangular closure slab and sealingly fit within the opening frame; a driver, the driver concealed in a recess behind the opening frame and coupled to a driver pulley; a frame pulley, concealed in a recess behind the opening frame on a side opposite the driver; and a cable having a proximal end and a distal end, disposed between the frame pulley the driver pulley, and operably coupled to the slab frame wherein the driver, the cable, the motor pulley and the frame pulley are concealed regardless of the position of the closure slab in relation to the opening frame, the assembly capable of slidably moving the slab between an open position and a closed position, wherein (i) the substantially rectangular closure slab comprises: an inner pane; and an outer pane, (ii) wherein each of the inner pane, and outer pane comprise a pane frame, (iii) wherein each of the inner pane, and outer pane comprise: a frame pulley associated therewith, (iv) the opening frame further comprises a driver operably coupled to a marine pulley and a cable associated with each of the inner pane, and outer pane, (v) the cable is operably coupled to the slab frame via a cable tension modulator, wherein (vi) each of the inner pane, and outer pane further comprises: a secondary frame pulley associated therewith, wherein the cable is looped around frame pulley and the secondary pulley and wherein the outgoing and returning cable direction are on the same side of each of the inner pane and outer pane, (vii) door of a closed structure comprising the assembly described herein, and (vii) the shafts of the first frame pulley and the secondary frame pulley are offset in relation to a longitudinal axis of a guide rail dispose on the opening frame, wherein (viii) the tension modulator is configured to maintain a system wide tension of between about 10 N and about 25 N, and (ix) a cable tension of between about 5 N and about 13 N, wherein (x) the assembly is embedded at the bottom of the pane frame, as well as (xi) a window of a closed structure comprising the assembly disclosed herein.

In yet another embodiment, provided herein is a motorized closure assembly, comprising: an opening frame configured to fit around at least the top horizontal side, a distal vertical side, and a bottom horizontal side of a substantially rectangular opening; a substantially rectangular closure slab having a closure slab frame configured to surround the substantially rectangular closure slab and sealingly fit within the opening frame; a driver, the driver embedded within a proximal vertical side of the substantially rectangular closure slab and coupled to a driver pulley; a frame pulley, embedded within and coupled to a distal horizontal side of the substantially rectangular closure slab on a horizontal side opposite the driver pulley; a first free pulley disposed between the driver pulley and the frame pulley and operably coupled to the closure slab frame; and a cable connecting the motor pulley, the first free pulley and the frame pulley, wherein the cable and the free pulley are embedded within the closure slab frame, wherein (xiv) in the open position, the closure slab is recessed within a pocket space in parallel alignment with the slab, configured to receive the closure slab; (xv) further comprising a first bracket operably coupled to the first free pulley, the first free pulley positioned parallel with the closure slab at an anterior side of the bracket and coaxially coupled to a first track wheel; (xvi) further comprising a second bracket operably coupled to a second free pulley, the second free pulley positioned parallel with the closure slab at an exterior side of the bracket, and coaxially coupled to a second track wheel; (xvii) the cable loops around the driver pulley and the first free pulley; (xviii) the cable loops around the driver pulley, the first free pulley, and the second free pulley; and (xix) pocket door comprising the assembly comprising: an opening frame configured to fit around at least the top horizontal side, a distal vertical side, and a bottom horizontal side of a substantially rectangular opening; a substantially rectangular closure slab having a closure slab frame configured to surround the substantially rectangular closure slab and sealingly fit within the opening frame; a driver, the driver embedded within a proximal vertical side of the substantially rectangular closure slab and coupled to a driver pulley; a frame pulley, embedded within and coupled to a distal horizontal side of the substantially rectangular closure slab on a horizontal side opposite the driver pulley; a first free pulley disposed between the driver pulley and the frame pulley and operably coupled to the closure slab frame; and a cable connecting the motor pulley, the first free pulley and the frame pulley, wherein the cable and the free pulley are embedded within the closure slab frame.

In an embodiment, provided herein is a motorized closure mechanism comprising: a driver; a cable or a belt configured to extend across a closure frame, coupled to a movable closure pane at a predetermined tension using a tension modulator, wherein the mechanism is integral and concealed within the closure frame, and wherein the tension is affected using biased coupling to the movable closure pane or to the driver, wherein (xx) the closure frame further comprises a driver operably coupled to a driver pulley and the cable wrapping around a frame pulley and looping around the driver pulley, associated with each of an inner pane, and an outer pane, wherein (xxi) each of the inner pane, and outer pane further comprises: a secondary frame pulley associated therewith, wherein the cable is looped around frame pulley and the secondary pulley and wherein the outgoing and returning cable direction are on the same side of each of the inner pane and outer pane, (xxii) the shafts of the frame pulley and the secondary frame pulley are offset in relation to a longitudinal axis of a guide rail dispose on the opening frame, wherein (xxiii) each of the inner pane, and outer pane further comprises: a secondary driver pulley associated therewith, wherein the cable is looped around the driver pulley and the secondary driver pulley and wherein the outgoing and returning cable direction are on the same side of each of the inner pane and outer pane, (xxiv) the shafts of the driver pulley and the secondary driver pulley are offset in relation to a longitudinal axis of a guide rail dispose on the opening frame, and wherein (xxv) the tension modulator is configured to maintain a cable tension of between about 5 $Kg_f$ and about 13 $Kg_f$.

While in the foregoing specification the motorized closures has been described in relation to certain preferred embodiments, and many details are set forth for purpose of illustration, it will be apparent to those skilled in the art that the disclosure of the motorized closures is susceptible to additional embodiments and that certain of the details described in this specification and as are more fully delineated in the following claims can be varied considerably without departing from the basic principles of this invention.

We claim:

1. A motorized closure assembly, comprising:

an opening frame configured to fit around an opening;

a substantially rectangular closure slab having a closure slab frame configured to surround the substantially rectangular closure slab and sealingly fit within the opening frame;

a driver coupled to a driver pulley, wherein said driver pulley is positioned on a top horizontal side of the opening frame;

a frame pulley positioned on an opposite side of the opening frame as the driver pulley;

a cable having a proximal end and a distal end, disposed between the frame pulley and the driver pulley, and the cable operably coupled to the slab frame;

wherein the rectangular closure slab defines a plane and the driver pulley and frame pulley at least partially intersects the plane; and wherein the driver, the driver pulley and the frame pulley are concealed behind or in the opening frame regardless of a position of the closure slab in relation to the opening frame, and wherein the driver of the motorized closure assembly is capable of slidably moving the slab between an open position and a closed position, and further wherein said assembly comprises multiple slabs serving as an inner pane and an outer pane that each slidably move in a separate parallel channel, wherein each of the inner pane, and outer pane comprise: a closure slab frame, a frame pulley associated therewith, and a secondary frame pulley associated therewith, wherein the cable is looped around the frame pulley and the secondary pulley and wherein an outgoing and returning cable direction are on a same side of each of the inner pane and the outer pane, and further wherein the frame pulley and the secondary pulley include shafts that are offset in relation to a longitudinal axis of a guide rail disposed on the opening frame.

2. The assembly of claim 1, wherein each of the inner pane, and outer pane comprise a driver operably coupled to a driver pulley and a cable wrapping around the frame pulley and looping around the driver pulley.

3. The assembly of claim 1, wherein the cable is operably coupled to the slab frame via a cable tension modulator.

4. The assembly of claim 3, wherein the tension modulator is configured to maintain a system wide tension of between about 10 Kg to about 25 Kg.

5. The assembly of claim 3, wherein the tension modulator is configured to maintain a cable tension of between about 5 Kg to about 13 Kg.

6. The assembly of claim 1, wherein the assembly is embedded at a bottom of the closure slab frame.

7. The assembly of claim 1, wherein the cable is positioned above the opening frame and below the slab frame or above the slab frame and below the opening frame.

8. The assembly of claim 1, wherein each driver pulley per each slab is positioned adjacently and parallel to another slab's driver pulley.

9. A motorized closure assembly, comprising:

an opening frame configured to fit around an opening;

a substantially rectangular closure slab having a closure slab frame configured to surround the substantially rectangular closure slab and sealingly fit within the opening frame;

a driver coupled to a driver pulley, wherein said driver pulley positioned on a top horizontal side of the opening frame;

a frame pulley positioned on an opposite side of the opening frame as the driver pulley;

a cable having a proximal end and a distal end, disposed between the frame pulley and the driver pulley, and the cable operably coupled to the slab frame;

wherein the rectangular closure slab defines a plane and the driver pulley and frame pulley at least partially intersects the plane; and wherein the driver, the driver pulley and the frame pulley are concealed behind or in the opening frame regardless of a position of the closure slab in relation to the opening frame, and wherein the driver of the motorized closure assembly is capable of slidably moving the slab between an open position and a closed position;

and further wherein said assembly comprises multiple slabs serving as an inner pane and an outer pane that each slidably move in a separate parallel channel, wherein each of the inner pane, and outer pane comprise: a closure slab frame, a frame pulley associated therewith, and a secondary driver pulley associated therewith, wherein an outgoing and returning cable direction are on a same side of each of the inner pane and outer pane, wherein the driver pulley and the secondary driver pulley include shafts that are offset in relation to a longitudinal axis of a guide rail disposed on the opening frame.

10. A motorized closure mechanism comprising:

a driver;

a driver pulley operably coupled to the driver, said driver pulley positioned on a top horizontal side of an opening frame;

a frame pulley;

a cable or a belt configured to extend across the opening frame between the driver pulley and the frame pulley, coupled to a movable closure slab frame at a predetermined tension using a tension modulator;

wherein the rectangular closure slab defines a plane and the frame pulley at least partially intersects the plane;

and wherein the predetermined tension is affected using biased coupling to the movable closure slab frame or to the driver, further wherein the cable extending between the frame pulley and the driver pulley is associated with each of an inner pane, and an outer pane, wherein each of the inner pane, and the outer pane further comprises: a secondary frame pulley associated therewith, wherein the cable is looped around the frame pulley and the secondary pulley and wherein an outgoing and returning cable direction are on a same side of each of the inner pane and the outer pane, wherein the frame pulley and the secondary frame pulley include shafts that are offset in relation to a longitudinal axis of a guide rail disposed on the opening frame.

11. The mechanism of claim 10, wherein the tension modulator is configured to maintain a cable tension of between about 5 Kg to about 13 Kg.

12. A motorized closure mechanism comprising:

a driver;

a driver pulley operably coupled to the driver, said driver pulley positioned on a top horizontal side of an opening frame;

a frame pulley;

a cable or a belt configured to extend across the opening frame between the driver pulley and the frame pulley, coupled to a movable closure slab frame at a predetermined tension using a tension modulator, wherein the rectangular closure slab defines a plane and the frame pulley at least partially intersects the plane;

and wherein the predetermined tension is affected using biased coupling to the movable closure slab frame or to the driver, further wherein the cable extending between the frame pulley and the driver pulley is associated with each of an inner pane, and an outer pane, wherein each of the inner pane, and the outer pane further comprises: a secondary driver pulley associated therewith, wherein the cable is looped around the driver pulley and the secondary driver pulley and wherein an outgoing and returning cable direction are on a same side of each of the inner pane and outer pane, wherein the driver pulley and the secondary driver pulley include shafts that are offset in relation to a longitudinal axis of a guide rail disposed on the opening frame.

* * * * *